United States Patent [19]

Nezworski

[11] Patent Number: 5,027,840

[45] Date of Patent: Jul. 2, 1991

[54] WASHING APPARATUS

[75] Inventor: James E. Nezworski, Waukesha, Wis.

[73] Assignee: Perlick Corporation, Milwaukee, Wis.

[21] Appl. No.: 596,671

[22] Filed: Oct. 12, 1990

[51] Int. Cl.[5] ..... B08B 3/02

[52] U.S. Cl. ..... 134/57; 134/95; 134/111; 134/135; 134/143; 134/200

[58] Field of Search ..... 134/180, 200, 111, 135, 134/81, 143, 144, 155, 167 R, 56 D, 57 D, 58 D; 51/421, 237 M, 240 T

[56] References Cited

U.S. PATENT DOCUMENTS

| | | | |
|---|---|---|---|
| 1,423,128 | 7/1922 | Liedtke | 51/421 |
| 1,713,965 | 5/1929 | Hull | 51/421 |
| 1,941,915 | 1/1934 | Rosenberger | 51/421 |
| 3,153,889 | 10/1964 | Millhiser | 51/421 |
| 3,324,867 | 6/1967 | Freese | 134/181 |
| 3,719,323 | 3/1973 | Raiser | 134/181 X |
| 4,143,669 | 3/1979 | Minkin | 134/200 |

*Primary Examiner*—Frankie L. Stinson
*Attorney, Agent, or Firm*—Godfrey & Kahn

[57] ABSTRACT

A washing apparatus for supplying a cleansing fluid to an object of interest including a housing for enclosing the apparatus and including a staging area and a washing area, a carousel rotatably borne by the housing and operable to carry the object of interest between the staging and washing areas, a spray manifold rotatably borne by the housing and operable for oscillating movement along a path of travel which is disposed in the washing area, supply means borne by the housing for selectively supplying the cleaning fluid to the spray manifold, a drive mechanism borne by the housing and operable drivingly to engage the manifold thereby causing the oscillating movement of the manifold; and means for selectively controlling the supply of cleansing fluid, and the drive mechanism, whereby the cleansing fluid may be supplied, and the drive mechanism may be selectively activated when the carousel is in a predetermined occluding position relative to the staging and washing areas.

17 Claims, 17 Drawing Sheets

WASHING APPARATUS

BACKGROUND OF THE INVENTION

1. Field of the Invention

The present invention relates to a washing apparatus for treating soiled containers and the like, and more particularly to an apparatus operable to cleanse and sanitize glass containers in a highly advantageous fashion not possible heretofore.

2. Description of the Prior Art

The prior art is replete with numerous examples of utensil washing devices which are operable for washing and sanitizing pots, pans, trays, glasses and other utensils by a single operator with a minimum of effort. In this regard there has been a multiplicity of industrial type glass washing or utensil washing devices which are of the rotary type and which include a casing which encloses a rotary table or substantially similar assembly, and which is operable to carry the items to be washed along a predetermined path of travel, and wherein along the path of travel the item to be washed is cleansed in a predetermined fashion and then returned to its point of origin where it is subsequently removed from the casing.

It should be understood that the washing of large numbers of glasses or mugs and the like is a burdensome logistical problem for large hotels and similar institutions in general. In this regard, the operation of washing large numbers of glasses includes two discrete operations. The first operation includes cleaning the glasses for purposes of removing substantially all foreign matter such as food residue, lipstick and other solid materials. The second operation includes the sterilization or sanitizing of the glass by the exposure of same to washing water which contains various soaps and chemical solutions maintained at high temperatures or in the alternative the application of chemical solutions such as iodine based or chlorine based sanitizers which may be applied at ambient temperatures.

Generally speaking, most of the commercially available glass washing machines which have been used by large institutions heretofore have been of the variety which includes a wash cycle which applies detergents and other chemical solutions at elevated temperatures. Further, and due in part to the cost of these washing machines, and other factors, large institutions have, in general, centralized their glass washing or utensil washing operations. This centralization, of course, causes these organizations' employees to move large numbers of glasses to and from the washing station. As might be expected, this movement of glasses, is usually time consuming and labor intensive, and further creates problems in terms of breakage of glasses and also inconvenience inasmuch as the movement of these glasses must often occur from many floors away.

Heretofore, the utensil washing devices employed by industry typically have been considered cumbersome machines. More specifically, the rotary type washing devices are quite complex, and generally include such features as separate chambers or separate time intervals for conducting the process of prerinse; washing; and final rinsing of the glasses being processed. As a result, machines of the type described are quite expensive, complicated, and usually require sophisticated control means to control the various cycles of the machine. Further, most machines require an experienced operator.

While these assorted industrial type washing devices are currently available and in widespread usage, they have suffered numerous shortcomings which have detracted from their usefulness. At the outset, such machines have not operated at full capacity and at peak efficiency due primarily to operator inattentiveness regarding the proper operating conditions of the machine. For example, some prior art washing devices require the periodic changing of the wash water. This operation may require that the operator physically remove a drain assembly and associated filter for purposes of draining the wash tank and then refill same with new wash water. Such prior art devices may also require the periodic monitoring of detergents and other sanitizers which may be fed automatically by the machine but which may require periodic replenishing. In addition, most industrial washing devices may be rendered partially inoperable when foreign matter such as paper is unintentionally introduced into the machine through operator error, it being understood that the paper may inhibit some of the operational features of the device such as clogging the filtering assembly or obstructing various draining conduits.

The problems attendant to operator error and which are related to the proper maintenance and operation of a washing device may be compounded somewhat when the operator fails to properly inspect the glasses upon completion of the wash cycle and the glasses are subsequently returned to their point of origin and thereafter the glasses are discovered to be unusable and must be returned to be washed again. Therefore the current washing devices do not balance the practical needs of the modern hotel or large institution and the interrelated parameters of efficiency and the logistical cost attendant to moving and processing such large amounts of glassware for purposes of washing and reuse.

Still another problem encountered with the prior art washing devices are a result of their individual designs inasmuch as such prior art industrial type washing devices typically are quite large and further require special operational environments which may include venting or ducting to accommodate air conditioning or which are operable to collect and remove fumes and water vapor from the vicinity of the washing device and expel it to the exterior ambient environment. Such special operational environments, of course, preclude the use of such machines in other than the centralized fashion as discussed previously.

Therefore, it has long been known that it would be desirable to have a washing apparatus which could be employed in a wide variety of different institutional environments and without the need for a special operational environment and which could be manufactured and purchased at a relatively moderate cost, and which is both highly efficient in operation and capable of operating with a minimal amount of preventive or on-going maintenance by an operator, and which further reduces to an absolute minimum the assorted problems associated with the cleansing and sterilization of large numbers of glasses.

SUMMARY OF THE INVENTION

Therefore, it is an object of the present invention to provide an improved washing apparatus which is operable to supply a cleansing fluid to an object of interest, such as a glass container, and the like.

Another object of the present invention is to provide such an apparatus which has particular utility in operation in treating and handling large numbers of glass drinking containers.

Another object of the present invention is to provide such a washing apparatus which is operable to obtain the individual benefits to be derived from related prior art washing apparatuses, while avoiding the detriments individually associated therewith.

Another object of the present invention is to provide such a washing apparatus which is operable to reduce to an absolute minimum the direct labor costs of processing a predetermined number of soiled glass vessels.

Another object of the present invention is to provide such a washing apparatus which includes control means which is operable to selectively control the dispensing of a cleansing solution to the soiled water vessels by way of an oscillating manifold which is disposed in an advantageous attitude relative to the soiled drinking vessels.

Another object of the present invention is to provide such a washing apparatus which is operable to treat a predetermined number of soiled drinking vessels rapidly, dependably, and efficiently while reducing to an absolute minimum the possibility of malfunction.

Another object of the present invention is to provide such a washing apparatus which is of relatively moderate cost to purchase and maintain and which is inexpensive to operate per volume of soiled drinking vessels treated during a washing cycle.

Another object of the present invention is to provide a washing apparatus wherein, in a first embodiment, the washing apparatus is operable to provide rinsing fluid to the soiled drinking vessels at ambient temperatures, and in a second embodiment the washing apparatus is operable to provide a rinsing fluid to the soiled drinking vessels at an elevated temperature.

Another object of the present invention is to provide a washing apparatus which is characterized by a compact configuration and which further may be utilized in relatively small working environments such as utility rooms, and the like, thereby permitting decentralization of the washing function in large institutions.

Another object of the present invention is to provide such a washing apparatus which may be utilized in combination with conventional dishwashing technology for purposes of further increasing the speed and efficiency with which a predetermined number of soiled drinking vessels can be treated during the washing process.

Another object of the present invention is to provide such a washing apparatus which is characterized by ease of employment, simplicity of construction and which can be sold at a relatively moderate price.

Further objects and advantages of the present invention are to provide improved elements and arrangements thereof in an apparatus for the purposes described which is dependable, economical, durable and fully effective in accomplishing its intended purposes.

These and other objects and advantages are achieved in a washing apparatus for supplying a cleansing fluid to an object of interest and which includes, a housing for enclosing the apparatus and including a staging area and a washing area; a carousel rotatably borne by the housing and operable to carry the object of interest between the staging and washing areas; a spray manifold rotatably borne by the housing and operable for oscillating movement along a path of travel which is disposed in the washing area; means borne by the housing for selectively supplying the cleansing fluid to the spray manifold; a drive mechanism borne by the housing and operable drivingly to engage the spray manifold thereby causing the oscillating movement of the spray manifold; and means for selectively controlling the supplying means and the drive mechanism whereby the supplying means and the drive mechanism can be selectively activated when the carousel is in a predetermined position relative to the staging and washing areas.

DESCRIPTION OF THE PREFERRED EMBODIMENT

First Form

Figure 1:
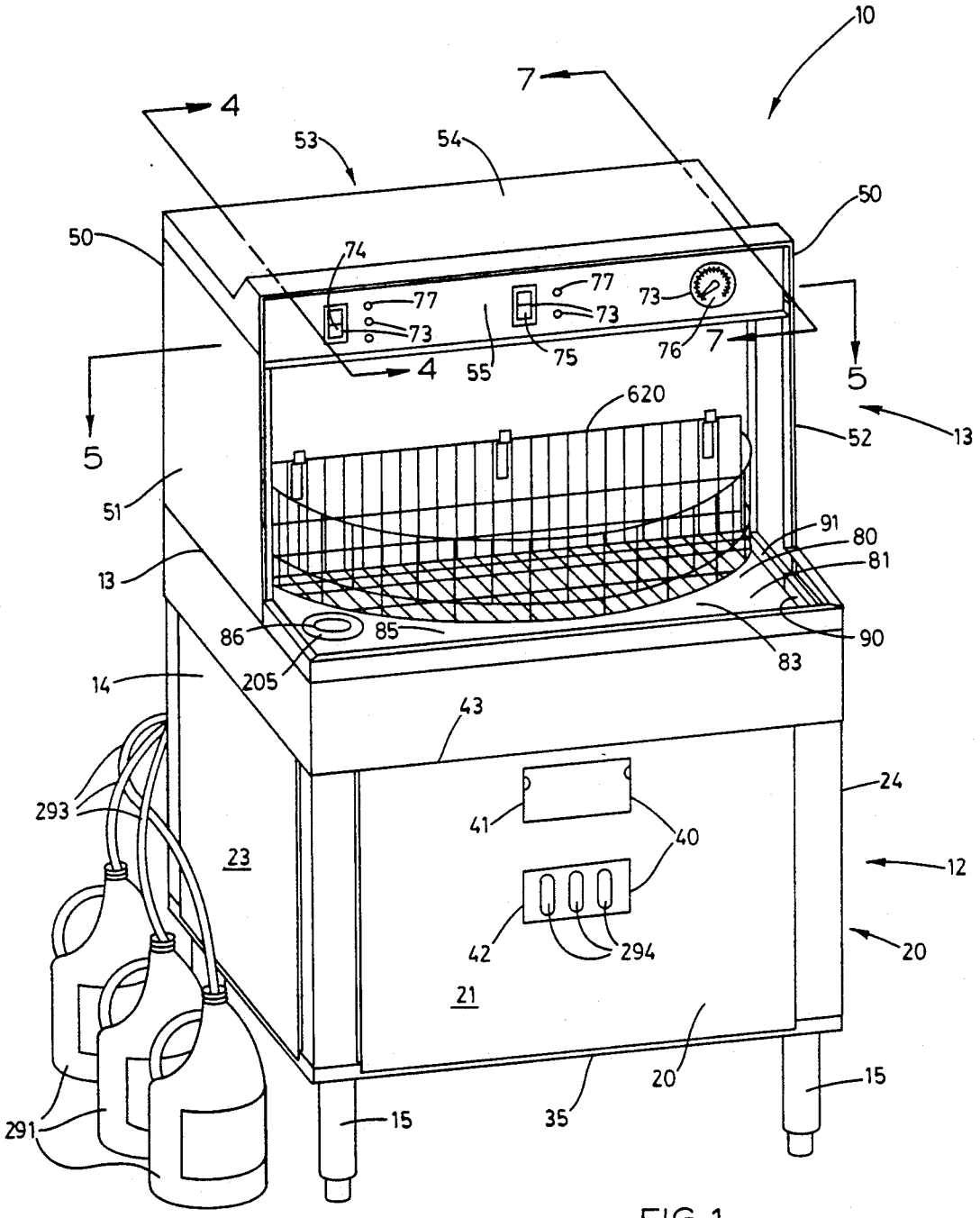
FIG. 1 is a perspective, front elevation view of the first form of the washing apparatus of the present invention and which is shown in a typical operational environment.
Figure 3:
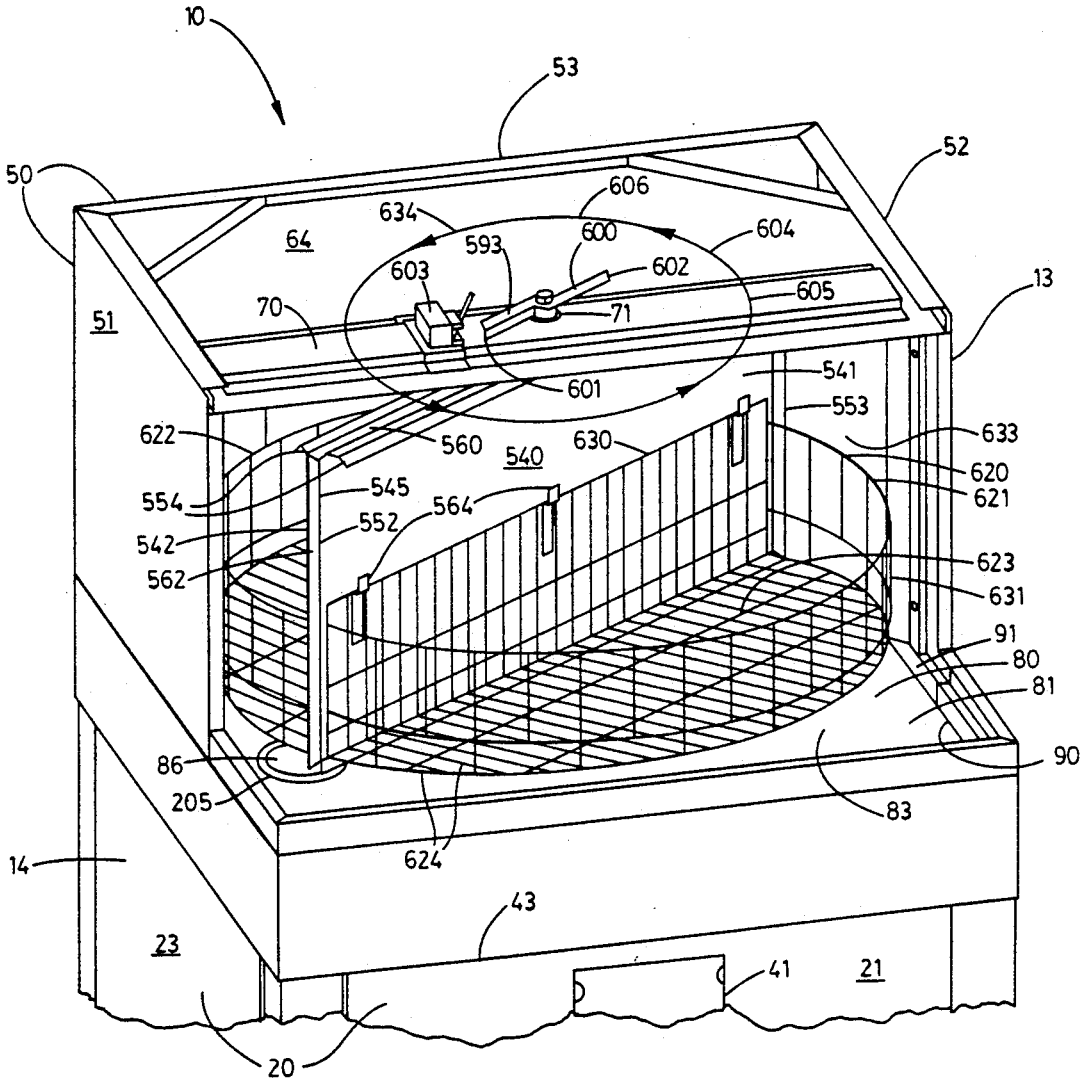
FIG. 3 is a fragmentary, perspective, front elevation view of the first form of the washing apparatus of the present invention with some supporting surfaces removed to show the structure thereunder.

The washing apparatus of the present invention is generally indicated by the numeral 10 in FIGS. 1 and 3. As illustrated therein, the apparatus 10 is shown resting on the surface of the earth 11 and is enclosed in a housing which is generally indicated by the numeral 12. The housing 12 includes top and bottom portions 13 and 14, respectively, and the bottom portion 14 is supported in spaced relationship relative to the surface of the earth 11 by means of leg members 15 or in the alternative, casters which renders the washing apparatus easily movable (not shown). The bottom portion 14 of the housing 12 has a plurality of sidewalls 20 which include forwardly and rearwardly disposed sidewalls 21 and 22 and left and right sidewalls 23 and 24, respectively, and which are positioned in substantially normal attitudes relative to each other. As best seen by reference to FIG. 8, the bottom portion of the housing has a plurality of vertically disposed support members 30 which includes first, second, third and fourth support members 31 through 34, respectively and which are positioned in the individual corners of the housing and which individually provide supporting surfaces upon which the sidewalls 21 through 24 may be fastened by using welding or other suitable fastening techniques. The respective sidewalls 21 through 24 define a first void 25 which is operable to receive various assemblies which will be discussed in greater detail hereinafter. Further the housing includes a bottom supporting surface 35 which is adapted to sealingly engage with the respective sidewalls 21 through 24 in a manner well understood in the art. An aperture 36 is formed in the bottom surface and is disposed in predetermined spaced relation relative to the rear wall 22. Further, the forwardly disposed sidewall 21 has formed therein a pair of substantially rectangularly shaped apertures 40 and which include a first aperture 41 and a second aperture 42. The respective apertures permits an operator to gain access to a control panel and to view a plurality of chemical flow indicators which will hereinafter be described in greater detail. The forwardly disposed sidewall 21 is defined by a peripheral edge 43 and is fastened to the housing 12 by means of suitable screw-type fasteners 44. It should be understood, therefore, that the forwardly disposed sidewall 21 may be easily removed from the housing to permit an operator to gain access to the first void 25 for purposes of maintenance modification and the like.

The top portion 13 of the housing 12 (FIG. 1) has a plurality of sidewalls 50 which include left and right sidewalls 51 and 52, a rear sidewall 53, and an upwardly disposed surface 54 which is individually joined to a reduced dimension, forwardly disposed sidewall 55. The inside surface 60 of the top portion 13 defines a second void 61. Further and mounted in the second void and fixed on the individual sidewalls 51, 52, and 53, and disposed in a substantially horizontal position is a ceiling member 62. The ceiling member 62 (FIG. 4) has an inside facing surface 63 and outside facing surface 64, respectively. An aperture 65 of predetermined dimensions is formed in the ceiling member and is disposed in a position adjacent to the forwardly disposed sidewall 55. As best illustrated by reference to FIGS. 3 and 4 a support bracket 70 is affixed by welding or the like to the inside surface 63 and has formed therein an aperture 71 of predetermined dimensions. Further, and as best illustrated by reference to FIG. 4, the outside facing surface 64 and the inside surface 60 of the upwardly disposed surface 54 defines a third void 72 which is operable to receive various mechanical and electrical components which will be discussed in greater detail hereinafter. As best seen by reference to FIG. 1 the forwardly disposed sidewall 55 has formed therein a plurality of apertures 73 which permit an operator to gain access to a power switch 74, a start-stop switch 75 and a temperature gauge 76. Further the plurality of apertures includes apertures which receive and hold several warning lights which will be discussed in greater detail hereinafter.

Figure 12B:
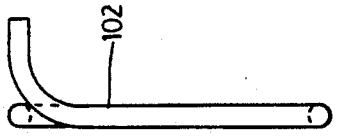
FIG. 12 A, B, and C are fragmentary, top plan, side elevation and end views, respectively, of the washing apparatus of the present invention and showing the lifting assembly thereof.
Figure 12A:
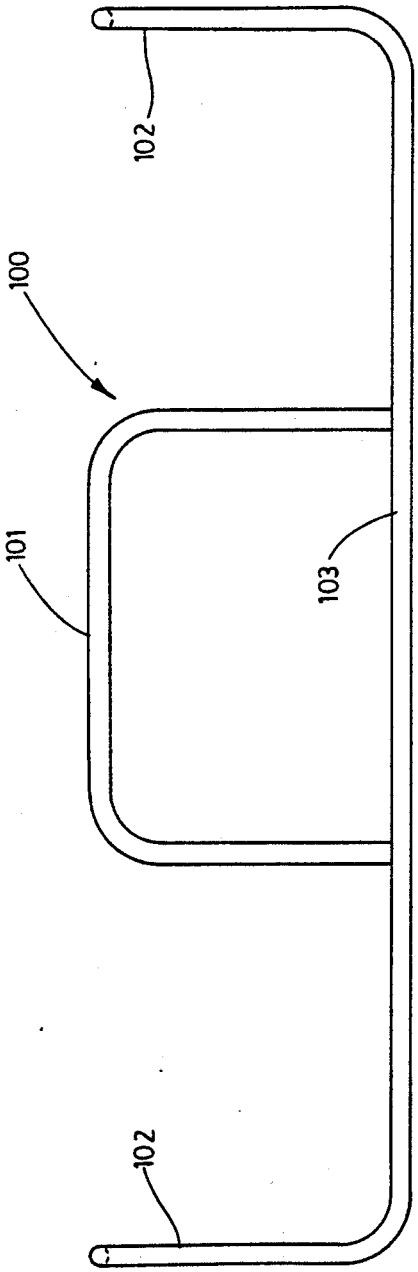
Figure 12C:
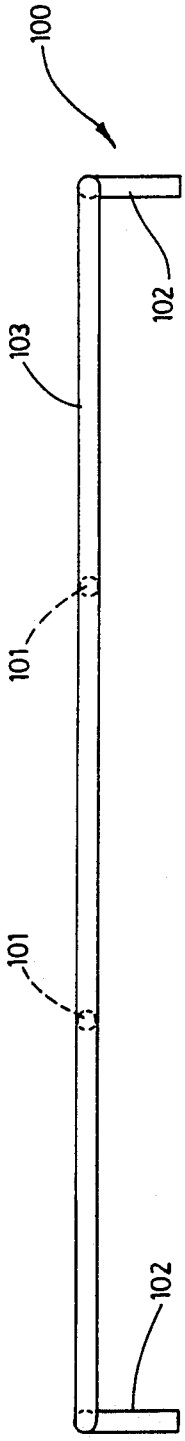
Figure 13:
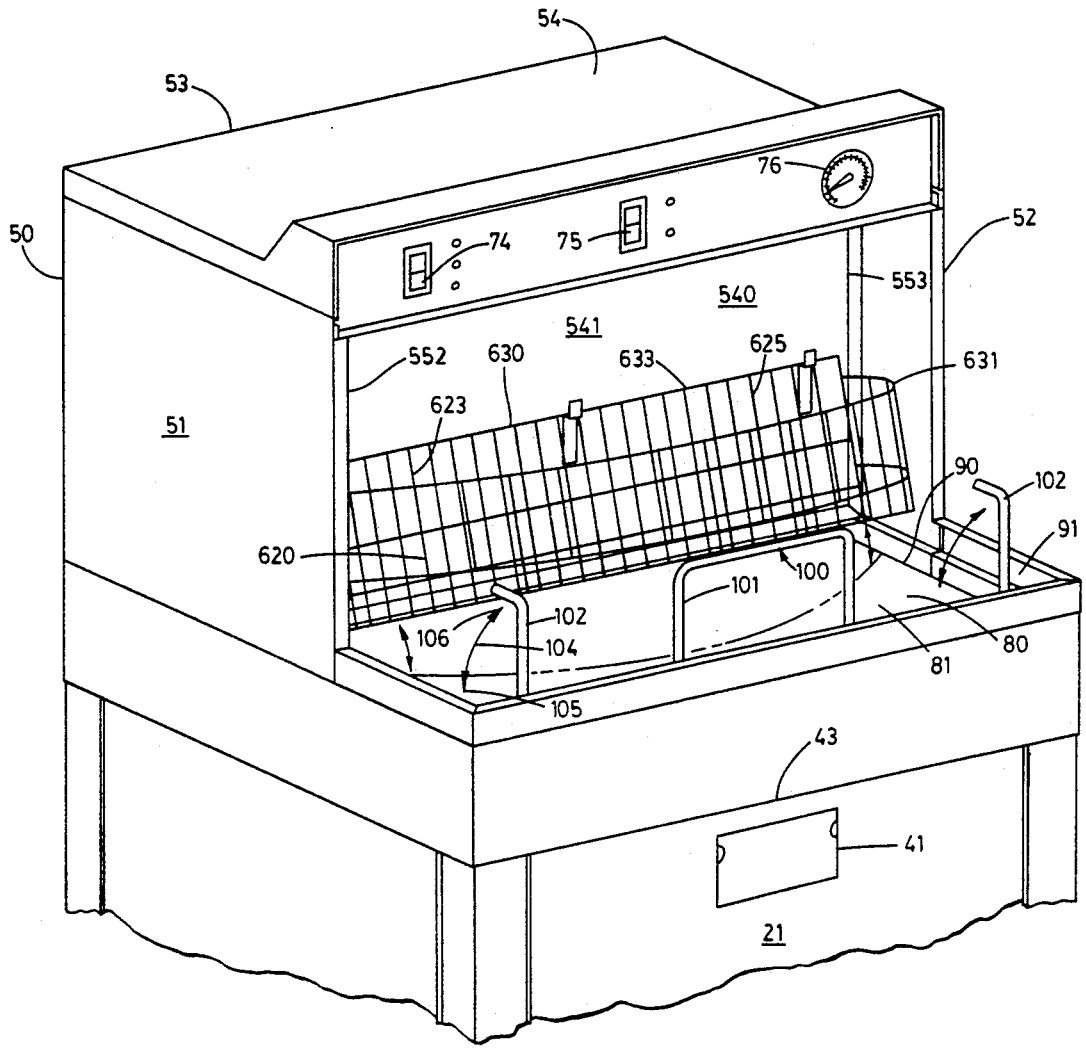
FIG. 13 is a fragmentary, perspective, front elevational view of the washing apparatus of the present invention and showing the lifting assembly thereof.

The housing 12 (FIG. 1) includes a pair of draining pans and which are generally indicated by the numeral 80. The draining pans 80 are designated hereinafter as a first or forwardly disposed draining pan 81, and which is accessible from the exterior of the housing, and a second or internally positioned draining pan 82, and which is enclosed by the bottom portion 14 of the housing and which is enclosed in the second void 61. The first or forwardly disposed draining pan 81 which defines a first staging area, has a main body 83 which includes a bottom supporting surface 84 and which has a substantially planar and upwardly disposed supporting surface 85. The supporting surface 85 is defined by a peripheral edge 90. A plurality of sidewalls 91 are made integral with the bottom surface and extend upwardly therefrom at a substantially normal attitude. As best illustrated by reference to FIG. 4 a lower flange member 92 is affixed using a suitable fastening technique, such as welding or the like, to the sidewall 91 which is disposed in a position which is most closely adjacent to the front wall 21 of the housing 12. Further, and positioned in spaced relationship relative to the lower flange member 92 is an upper flange member 93. A space 94 is defined between the upper and lower flange members. As seen most clearly by reference to FIGS. 4 and 12 the upper and lower flange members 92 and 93, respectively are operable to secure an elevating assembly which is generally indicated by the numeral 100 to the sidewall 91.

The elevating assembly 100 includes a central portion 101 which is substantially rectangularly shaped, and which is operable to engage a foraminous container in the manner which will be discussed in greater detail hereinafter. As best seen by reference to FIG. 12 the elevating assembly includes a pair of supporting legs 102 which are disposed in predetermined, substantially parallel spaced relationship to the central portion and which are operable to rest on the supporting surface 85 of the first or forwardly disposed draining pan 81. The central portion 101 and the supporting legs 102 are affixed or made integral with a rearwardly disposed support member 103 which is received in the space 94 which is defined between the upper and lower flange members 92 and 93 respectively. As best illustrated by reference to FIG. 4 the elevating assembly 100 is operable to be moved by an operator along a substantially arcuately shaped path of travel 104 from a first non-supporting position 105, wherein it is disposed in a substantially horizontal position relative to the supporting surface 85, to a second substantially vertical and supporting position 106 wherein the central portion is operable to engage the previously mentioned foraminous container in a manner whereby it is individually disposed in angulated spaced relationship relative to the draining pan 81. In this angulated position, the foraminous container encourages the draining of liquid from those articles (not shown) which are carried in the foraminous container and which have been previously washed. The foraminous container as well as other features of the present invention which support the foraminous container will be discussed in greater detail hereinafter.

Figure 4:
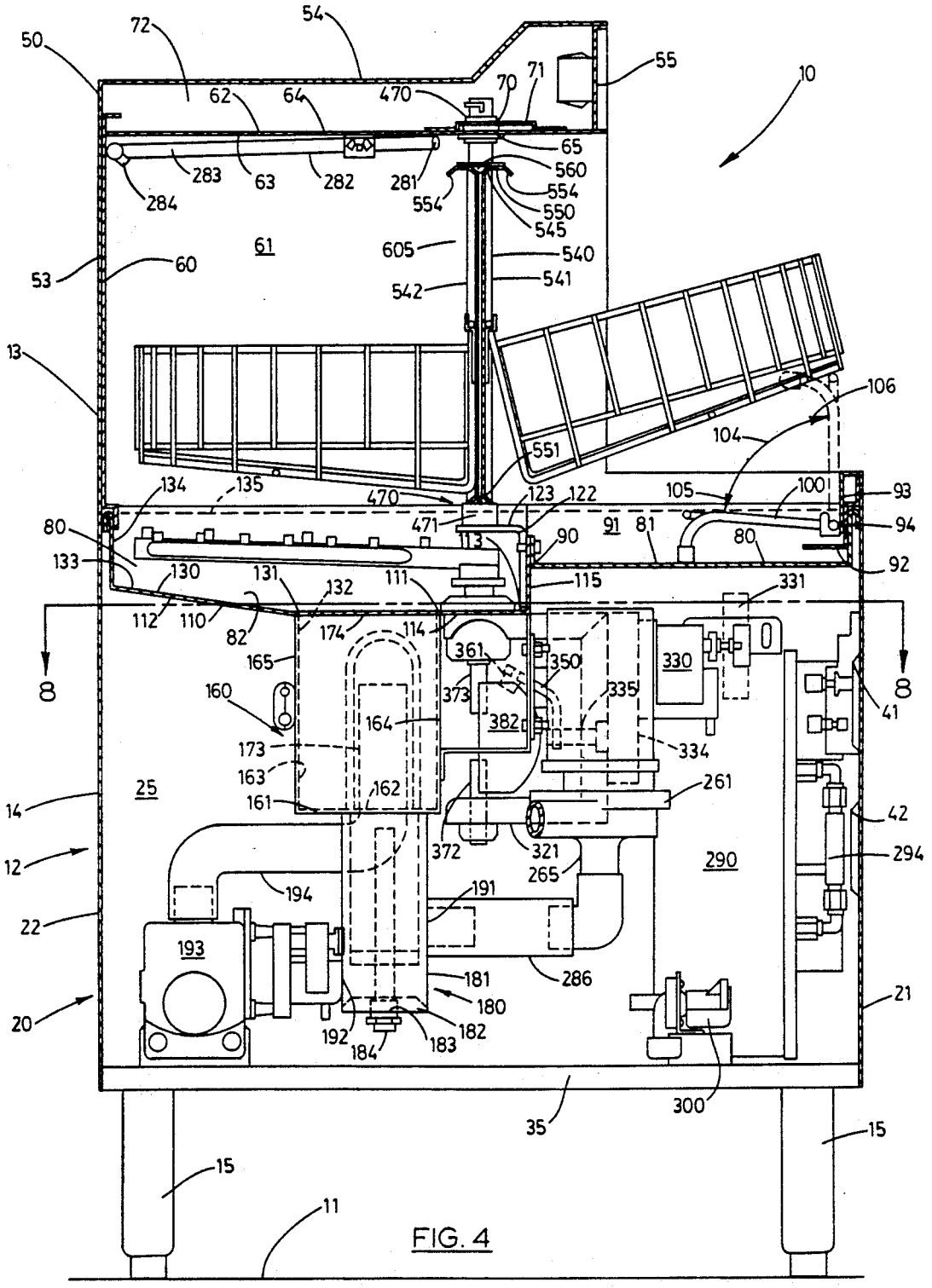
FIG. 4 is a longitudinal, vertical, sectional view of the apparatus of the subject invention and which is taken from a position along line 4—4 of FIG. 1 and which further has some supporting surface removed to show the detail thereunder.

As best seen by reference to FIG. 4 the second or inwardly positioned draining pan 82 defines a washing area and is affixed to the first draining pan 81. The second draining pan 82 has a main body 110 which includes a first or forwardly disposed portion 111 and a second or rearwardly disposed portion 112. The first portion 111 has a bottom supporting surface 113 which has formed in a predetermined location an aperture 114. Further, a sidewall 115 is made integral with the bottom surface and extends upwardly at a substantially normal attitude thereto. As best illustrated by reference to FIG. 4, a plurality of apertures 120 are formed in the sidewall 115 and are operable to receive individual fasteners 121 of conventional design. These fasteners connect the first portion 111 of the second drain pan 82 to the first drain pan 81. Affixed to the sidewall 115 by employing several of the same fasteners 121 is a supporting, L-shaped bracket 122. The L-shaped bracket 122 includes an upper and substantially horizontally disposed leg 123 which has formed therein a substantially U-shaped and recessed slot or channel 124. The rearwardly disposed portion 112 of the drain pan 82 includes a bottom supporting surface 130 which is defined by a peripheral edge 131. The peripheral edge includes an inwardly facing edge 132 and an outwardly facing edge 133 which is individually affixed to several internal sidewalls 134 and which extend upwardly in a substantially vertical attitude relative thereto. Additionally, and as best illustrated by reference to FIGS. 4 and 7 the bottom supporting surface 130 is defined by a plurality of inclined surfaces or portions and which converge in a substantially central location relative to the first void 25 and which facilitate the draining of water and chemicals which are applied to the glasses (not shown) and which are to be processed in the second void 61. The internal sidewalls 134 extend upwardly and in spaced relationship relative to the rearwall 22 and the left and right sidewalls 22 and 24, respectively. This is best seen by reference to FIG. 4. The internal sidewalls 134 define an internal chamber 135. Further and as best seen by reference to FIG. 8 an aperture 136 of predetermined dimensions is formed in one of the internal sidewalls 134 and is operable to permit the entry of water which is supplied to the apparatus 10.

The apparatus 10 includes a primary or first tank and which is generally indicated by the numerals 160. The primary tank 160 is made integral with, and is disposed in fluid receiving or draining relationship relative to the bottom supporting surfaces 113 and 130, respectively, of the forwardly and rearwardly disposed portions 111 and 112 of the rearwardly positioned drain pan 82. In this regard, the primary tank includes a bottom, substantially horizontally disposed surface 161 which is defined by a peripheral edge 162. Extending upwardly and at a substantially normal attitude relative to the bottom surface is a plurality of interconnected sidewalls 163 which include front and rear sidewalls 164 and 165, respectively, and left and right sidewalls 170 and 171, respectively. As best illustrated by reference to FIG. 8 an aperture 172 is formed substantially centrally of the bottom surface and is operable to accommodate, and sealingly receive and support, an overflow pipe 173 which is operable to control the level of water which is received in the primary tank 160. Connected in fluid draining relation and disposed downstream from the primary tank is a sump tank 180 of predetermined dimensions. The sump tank 180 includes a substantially cylindrically shaped sidewall 180 which has a predetermined length dimension, and which further includes a bottom surface 182. As best illustrated by reference to FIG. 4, an aperture 181 of predetermined dimensions is formed substantially centrally of the bottom surface 182 and is operable to accommodate and sealingly secure a heater element in a predetermined position. The heater element is of a conventional design. The heater element, of course, is operable to impart heat energy to the water received in the sump thereby maintaining it at a predetermined temperature. Further, a pair of apertures are formed in the cylindrical sidewall 181. The individual apertures include first and second apertures 191 and 192, respectively. The first aperture 191 is disposed upstream of the second aperture 192. Further, the second aperture 192 is disposed in fluid draining relation relative to a drain valve 193 and which is fixed on the bottom supporting surface 35 of the bottom portion 14 of the housing 12.

The drain valve 193 is of conventional design and therefore, for the sake of brevity, is not discussed in significant detail herein. However it should be understood that the drain valve is selectively operable to drain a mixture of water and other chemicals from the primary and sump tanks 160 and 180 respectively upon receiving predetermined electrical signals from a control assembly and which will be discussed in greater detail hereinafter. Further, and as best illustrated by reference to FIG. 8, a conduit 194 connects the overflow pipe 173 in fluid receiving relation relative to the drain valve 193 in such a fashion wherein the mixture of water and chemicals entering the overflow pipe flow into the drain valve and are then expelled from the apparatus 10. Further, and as best illustrated by reference to FIG. 11 a substantially continuous flange 195 is mounted on the inside surface of the sidewall 181 and in spaced relationship relative to the bottom surface 182 thereof and which is operable to engage and support a filtering assembly in spaced relation relative to the bottom surface 182. The filtering assembly will be discussed in greater detail hereinafter.

Figure 8:
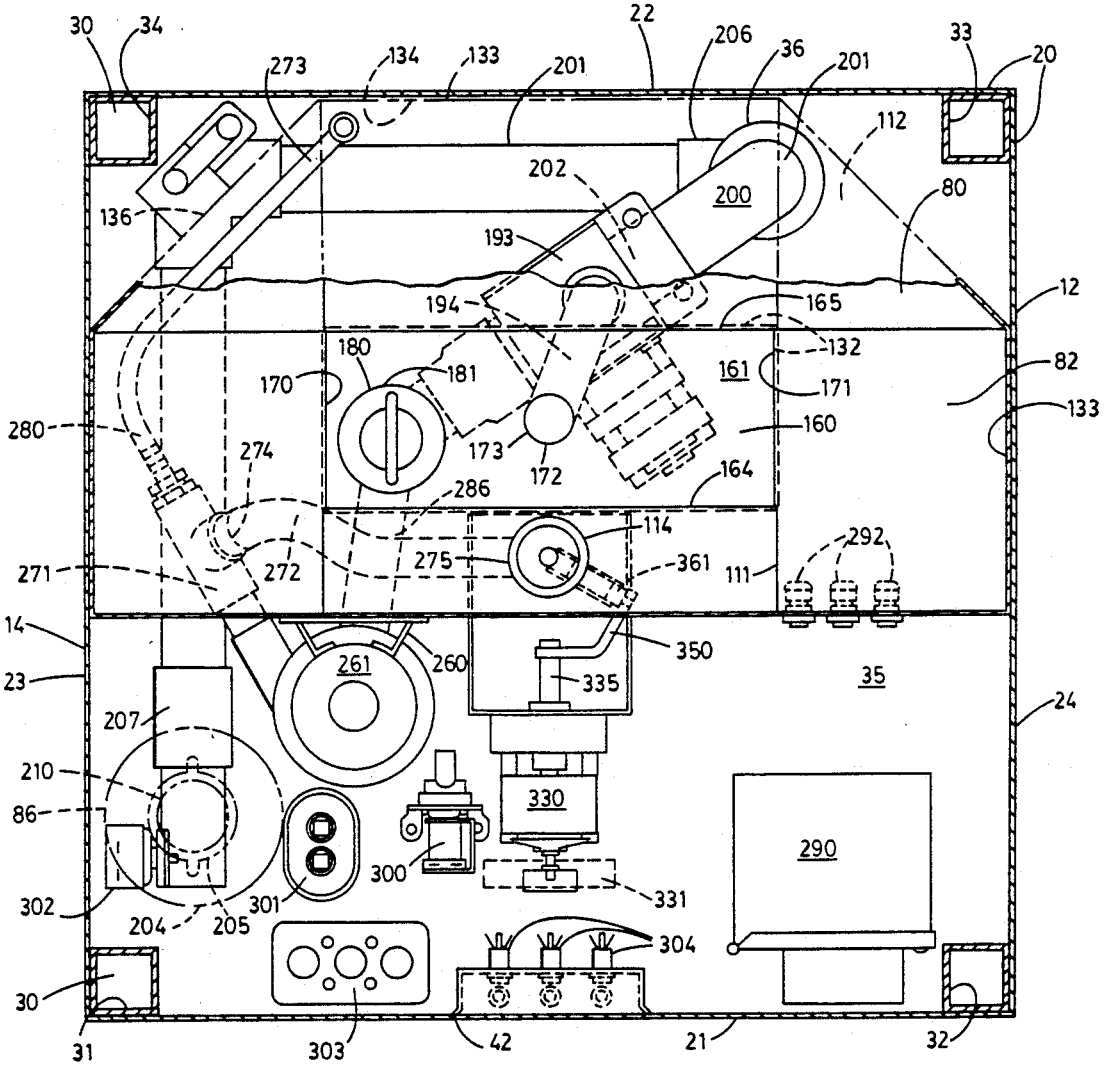
FIG. 8 is a top plan view of the first form of the washing apparatus of the subject invention and taken from a position along 8—8 of FIG. 4.

As best illustrated by reference to FIG. 8 a first draining conduit 200 is operable to connect the drain valve 193 in fluid draining relation relative to the aperture 36 and which is formed in the bottom supporting surface 35 of the housing 12. The conduit 200 includes a first end 202 which is fixed in substantially sealing relation about the aperture 36, and an opposite second end 203 is sealingly mounted in fluid draining relation relative to the valve 193. Further, and as best illustrated by a study of FIGS. 1 and 8 a draining assembly, and which is generally indicated by the numeral 204 is made integral with a second draining conduit 201, and which has opposite first and second ends 206 and 207 respectively. As best seen, by reference to FIG. 1, the draining assembly is made integral with the first or forwardly positioned draining pan 81 and is fixed in fluid draining relation relative to the second end 207 of the conduit 201. The draining assembly includes a funnel-shaped main body 205 which is operable to receive a cup shaped screen or filter member 210 of conventional design. It should be understood that water or other fluids draining from the glasses or other vessels which were previously washed, and which are positioned in the vicinity of the first drain pan, moves under the influence of gravity into the draining assembly and thereafter along the second conduit 201 and out of the apparatus 10 by way of the aperture 36. The cup shaped screen 210 is operable to trap any particulate matter that may be suspended in the water entering into the second conduit 201.

Figure 14:
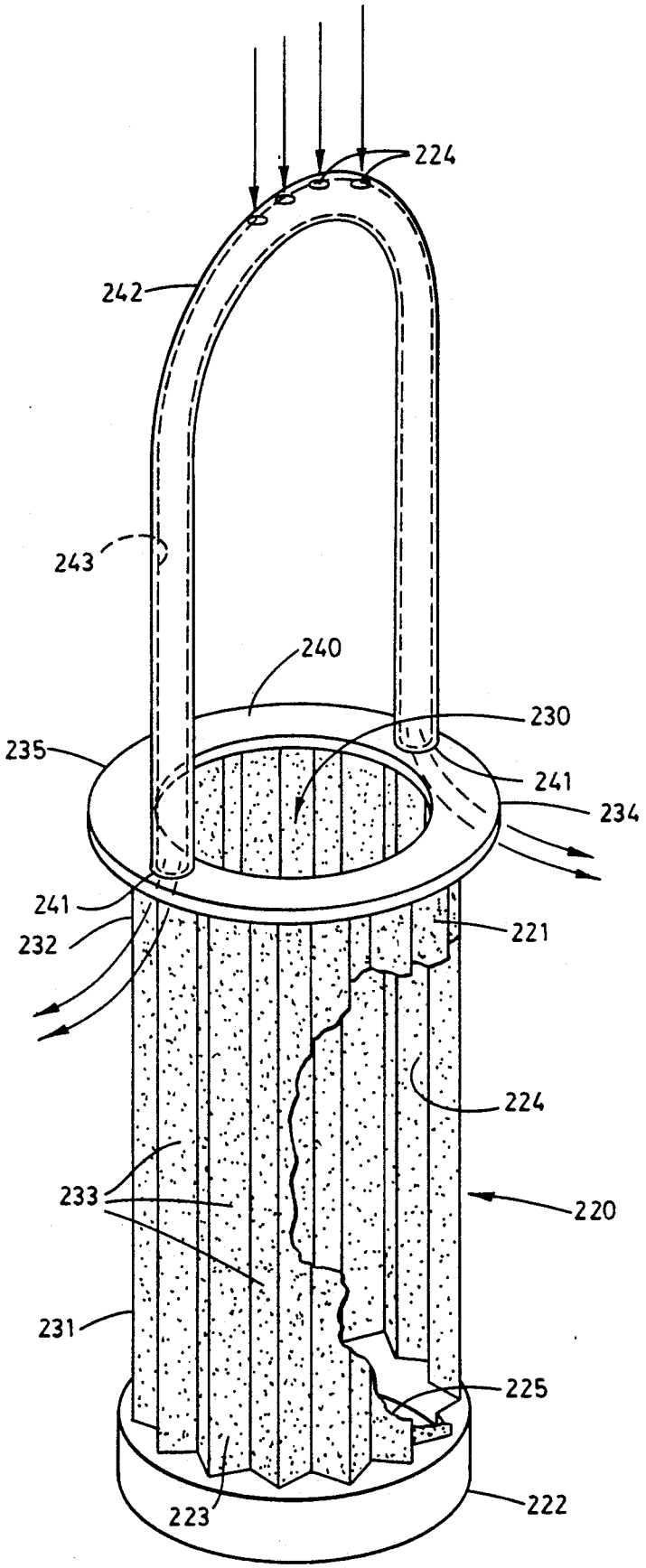
FIG. 14 is a somewhat enlarged, perspective, side elevation view of the washing apparatus of the present invention with some supporting surfaces removed, and showing the filtering assembly thereof.

As best illustrated by reference to FIGS. 4 and 14 a filtering assembly 220 is operable to be matingly received in substantially telescoping relation relative to the sump tank 180 shown. The filtering assembly has a generally cylindrical shape and a foraminous main body which is generally indicated by the numeral 221. The main body further includes a substantially annular shaped base member 222. The main body also includes an undulating exterior surface 223 and an interior surface 224. The interior and exterior surfaces 223 and 224 are fixed in predetermined spaced relation one to the other thereby defining a space 225 of predetermined dimensions therebetween. Further the interior surface defines an annular bore or passageway 230. The foraminous main body 221 includes a first end 231 and an opposite distal end 232. The first end 231 is fixed by conventional fastening techniques to the base member 222. Further, and as best illustrated by reference to FIG. 14, the foraminous main body includes a plurality of small aperatures 233 which are formed in the interior and exterior surfaces 223 and 224, respectively, and which permit the movement of fluid therethrough when the filter assembly is received in the sump tank. An annular frame member or ring 234 is affixed by utilizing conventional fastening techniques to the second end 232 of the foraminous main body 221. The annular ring 234 has an inside facing surface 235 and an outside facing surface 240. Further and as best illustrated by reference to FIG. 14 a pair of apertures 241 of predetermined dimensions are formed in opposite sides of the ring and are further disposed in fluid flowing registery with the space 225. A U-shaped conduit is affixed to the ring and is disposed in substantial registry with the pair of apertures 241. The U-shaped conduit, which is manufactured from materials that are similar to the main body defines a passageway 243. Further, a plurality of apertures 244 are formed in the U-shaped conduit and which permit the ambient atmosphere to enter into the conduit when the filter assembly is positioned in the sump tank 180 as shown in FIG. 4. As should be understood, and when positioned in the sump tank, the U-shaped conduit and more specifically that portion of the U-shaped conduit which has formed therein the plurality of apertures 244 is positioned above the fluid level that would normally be received in the primary tank 160. The significance of this feature will be discussed in greater detail hereinafter.

Figure 11:
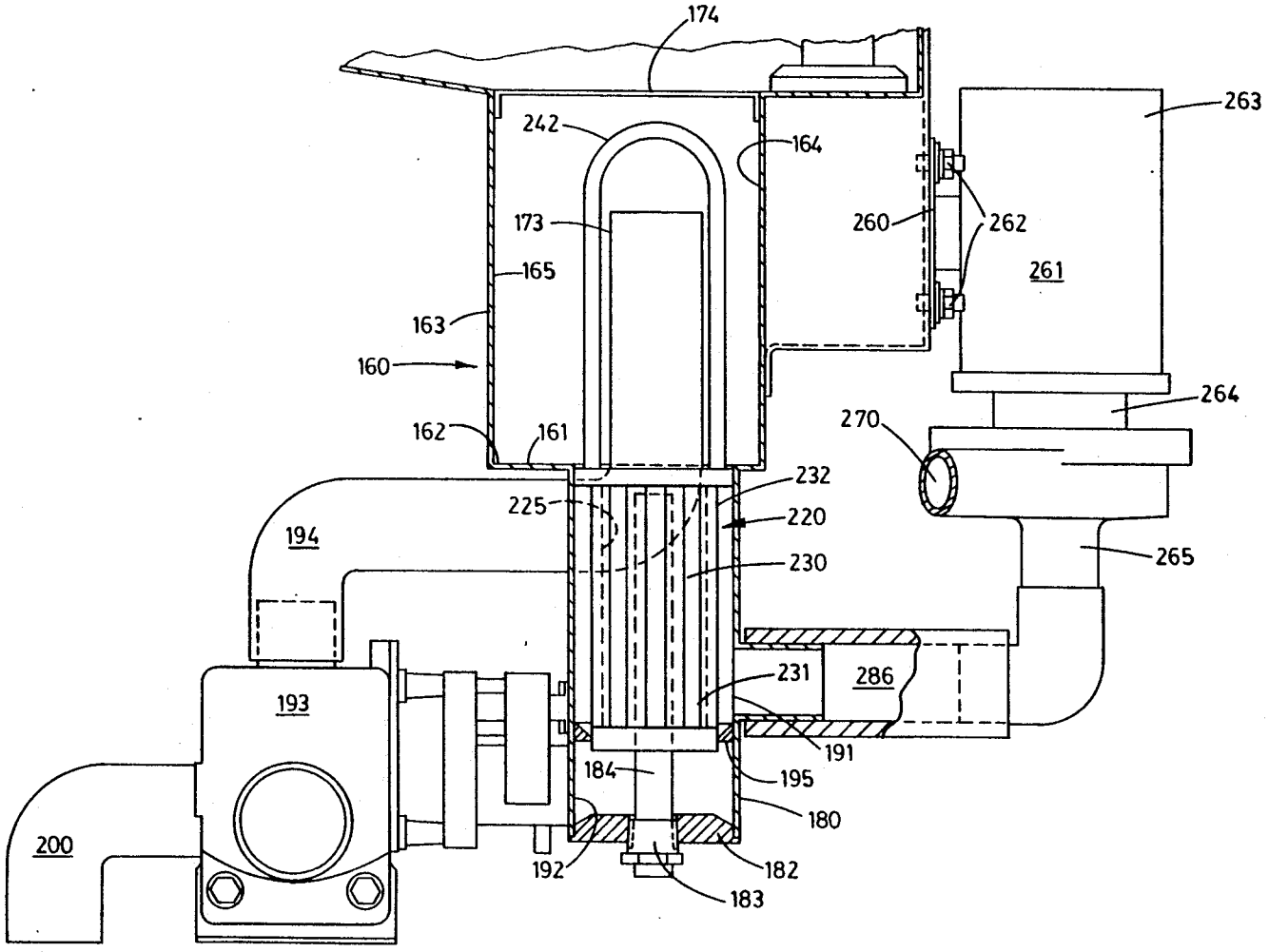
FIG. 11 is a somewhat enlarged, partial, vertical sectional view of the washing apparatus of the present invention and showing the washing tank, and filtering assembly thereof.

As best illustrated by reference to FIG. 11 a substantially L-shaped support member 260 is affixed using conventional fastening techniques to the front wall 164 of the primary tank 160. The L-shaped support member is operable to position a pump 261 in predetermined spaced relationship relative to the bottom surface 35 of the housing 12. The pump 261 is fixed to the L-shaped support member by utilizing a plurality of fasteners 262. The pump 261 has a first end 263 and a second end 264, which is remote thereto. The second end includes an inlet or water intake 265 and an outlet or water discharge 270. As best seen by reference to FIG. 8 a discharge conduit and which is generally indicated by the numeral 271 is disposed in fluid receiving relationship relative to the water discharge end 270. The discharge conduit 271 includes a first branch 272 and a second branch 273. As best illustrated by reference to FIGS. 5 and 8, the first and second branches include proximal and distal ends 274, 275, 280 and 281, respectively. As best seen by reference to FIG. 5 the distal end 281 of the second branch 273 extends from the first void 25 into second void 61. Further, and attached to the outside surface 64 of the ceiling member 62 is a stationary or upper spray manifold 282. The spray manifold 282 includes a main body 283 which defines a channel, not shown, but which is operable to conduct fluid pumped by the pump to a plurality of spray nozzles 284 which are positioned in predetermined locations along its length. The spray nozzles are angled downwardly to direct the fluid into the second void in an advantageous fashion. Further and as best illustrated by reference to FIG. 5 a fill chute 285 is affixed to the sidewall 134 and is operable to direct incoming water into the primary tank 160 in FIG. 8. In this regard the fill chute conducts fluid into the housing 12 and directs it through the aperture 136 which is formed in the sidewall 134. The fluid exiting the aperture 136 then runs across the bottom supporting surface 130 and into the primary tank 160. In addition to the foregoing a conduit 286 is operable to connect the sump tank 180 by way of the first aperture 191 in fluid communication with the pump 261. This is best illustrated by reference to FIG. 11. It should be understood the fluid received in the primary tank will exit under the force of gravity through the sump tank and be filtered by the filtering assembly 220. Upon activation of the pump 261 the fluid from the sump tank 180 is drawn through the conduit 286 and thereafter is discharged by way of the water discharge end 270. The water then travels on through the first and second branches 272 and 273 of the discharge conduit. The fluid received in the second branch is discharged by means of the stationary or upper spray manifold 282 into the second void 61, and the first branch delivers water to the spray manifold which will be discussed in greater detail hereinafter.

The apparatus 10 in FIG. 1 includes a plurality chemical pumps and which are generally indicated by the numeral 290, and which include electrical subassemblies, not shown, and which are operable to activate the chemical pumps in a fashion well understood by those skilled in the art. The chemical pumps employed in the present invention are of conventional design and therefore they are only discussed in cursory detail herein. However, it should be understood that the chemical pumps are operable to discharge various chemicals such as detergents, rinse aids and assorted water conditioners in predetermined volumes from the several containers 291 through chemical fill fittings 292 and into the chamber 135 which is defined by the internal sidewalls 134. The chemicals then travel, under the influence of gravity, into the primary tank 160 and are there intermixed with the water which is released into the primary tank 160 by way of the fill chute 285 which was discussed above. Mounted in the vicinity of the chemical pumps is a control assembly, not shown, and which controls the operations of the various subassemblies discussed herein. The control assembly includes an integrated control means which defines the intervals of time during which various activities take place. This is best understood by a study of FIG. 17.

As best illustrated by reference to FIG. 1 the previously mentioned chemicals are supplied in disposable containers 291 and which are positioned in a location exterior to the apparatus 10. It should be understood, of course, that these chemical supplies may be positioned internally of the housing 12 if conditions warrant. Further, conduits 293 are positioned in fluid receiving relation relative to the chemicals and the individual chemical pumps are operable to withdraw the chemicals from the disposable containers and supply them to the primary tank 160. As best illustrated by reference to FIG. 4 the apparatus 10 includes a plurality of chemical flow indicators 294 which provide a means by which an operator, not shown, may view the flow of the chemicals being supplied by the individual chemical pumps to verify the proper operation of same.

Figure 15:
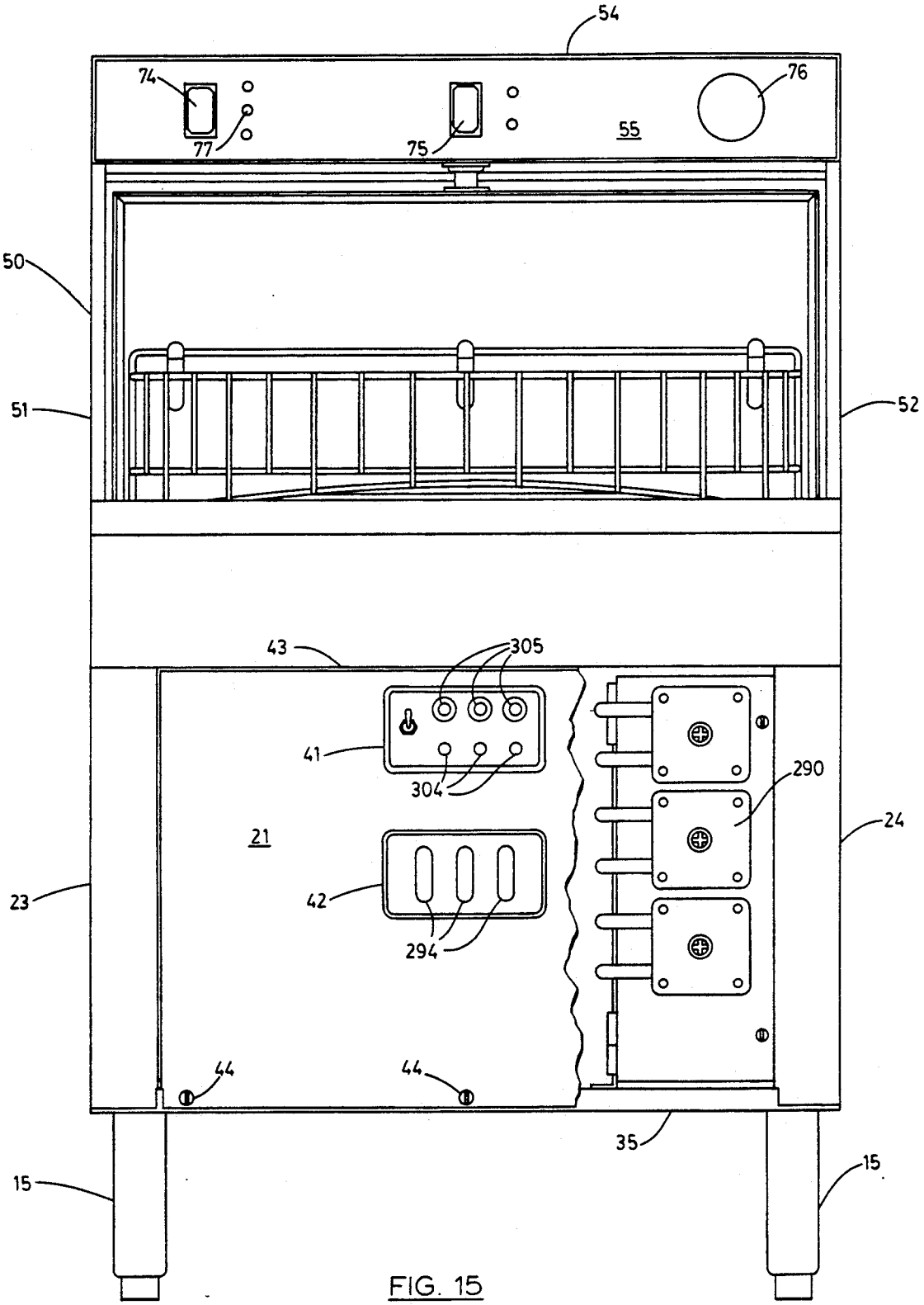
FIG. 15 is a front elevational view of the first form of the washing apparatus of the present invention with some supporting surfaces removed to illustrate the structure thereunder.

The apparatus 10 includes a water inlet solenoid 300, of conventional design and which is operable to control the selective supply of water to the fill chute upon the command of the control means which will be discussed hereinafter. The water inlet solenoid is disposed in signal receiving relation relative to the power switch 74 (FIG. 1) and the stop/start switch 75 by means of a plurality of electrical conductors, not shown. The operation of the water inlet solenoid will be discussed in greater detail hereinafter. A run capacitor 301 for the pump motor and which is of conventional design, is fixed on the bottom surface 35 of the housing 12 and is operable to control the operation of an electric motor, and which will be discussed in greater detail hereinafter. Further, a heater control assembly 302 is also fixed on the bottom surface 35 and is operable to control the heater element 184 which is positioned in heat transferring relation relative to the sump tank 180. The heater control, of course, is operable to maintain the water in the primary tank at a predetermined temperature throughout the operation of the apparatus 10. An electrical box 303 of conventional design (FIG. 8) is mounted on the bottom surface 35 and is operable to receive a source of external power and provide a distribution of same to the various subassemblies, such as the heater control, and solenoids which were discussed earlier. Further, a plurality of indicating lights 304 (FIG. 15) are affixed on a supporting panel and are disposed in the opening 41 which is formed in the front surface of the housing 12. In this position the indicating lights may be readily viewed by an operator who is operating the apparatus 10. As should be understood, the indicating lights are operable to show the flow of the various chemicals. Further, the chemical pumps include a plurality of adjustment members 305 which may be manually adjusted by the operator to control the various operating parameters of the chemical pumps.

As best illustrated by reference to FIGS. 9 and 10 the apparatus 10 of the present invention includes an oscillating drive mechanism and which is generally indicated by the numeral 320. The oscillating drive mechanism 320 is mounted in predetermined spaced relationship relative to the bottom surface 35 of the housing 12 by means of a supporting frame and which is generally indicated by the numeral 321. The supporting frame includes lower and upper leg members 322 and 323, respectively. Each of the members also include a supporting surface 324. Further, and as best seen by reference to FIG. 9 individual, substantially coaxially aligned apertures 325 are individually formed in predetermined positions in the upper and lower leg members, respectively. Further, a substantially vertically disposed leg member 326 connects the upper and lower leg members together thereby forming a rigid frame. An electric motor 330 of substantially conventional design is affixed to the vertically disposed leg member 326 using conventional fastening techniques. The motor 330 has a drive shaft 332 which has affixed thereto a fan assembly 331. The fan assembly is affixed on the drive shaft using a conventional fastener. Further, the drive shaft has a distal end 333 which extends outwardly therefrom and which is disposed in driving relationship relative to a gear reduction assembly 334. Likewise, the gear reduction assembly 334 is of conventional design and therefore for the sake of brevity is not discussed in significant detail herein. The gear reduction assembly includes a drive shaft 335 which extends outwardly therefrom. The drive shaft is enclosed in a housing 340 and the drive shaft includes a first end 341 which is made integral with the gear reduction assembly and a second end 342 which is remote thereto. As best illustrated by reference to FIG. 9 an aperture 343 is formed in the second end 342 of the drive shaft 335 and is operable to receive a pin 344 of predetermined dimensions. Further a washer 345 is received about the drive shaft 335 and is operable to rest against the gear reduction assembly. In addition to the foregoing, a biasing spring 346 is telescopingly received about the drive shaft 335.

Mounted on the second end 342 of the drive shaft 335 is an angulated drive arm 350 and which includes a first portion 351 and a second portion 352 which is disposed in angulated relation thereto. The second portion 352 has a proximal end 353 which is fixed on the first portion 351, and a distal end 354. As best seen by reference to FIG. 9, an aperture 355 is formed in the first portion 351 and is operable to receive the drive shaft 335. Further, a notch 356 is formed in the first portion. As should be understood, the drive shaft 335 which is slidably received on the first portion of the drive arm is urged, by means of the biasing spring, towards the second end 342 thereby urging the pin 344 into the notch 356. This secures the first portion 351 in a predetermined position relative to the drive shaft 335. Further, and formed in the distal end 354 of the second portion 352 is an aperture 360 of predetermined dimensions and which is operable to receive a cam follower which is generally indicated by the numeral 361. The cam follower has a rotatable main body 362 which is secured on the distal end of the second portion by means of an axle assembly 363 which is secured by a suitable threadable fastener. The drive arm is operable to move along a substantially circular path of travel 364 and which is best seen by reference to FIG. 10.

Figure 9:
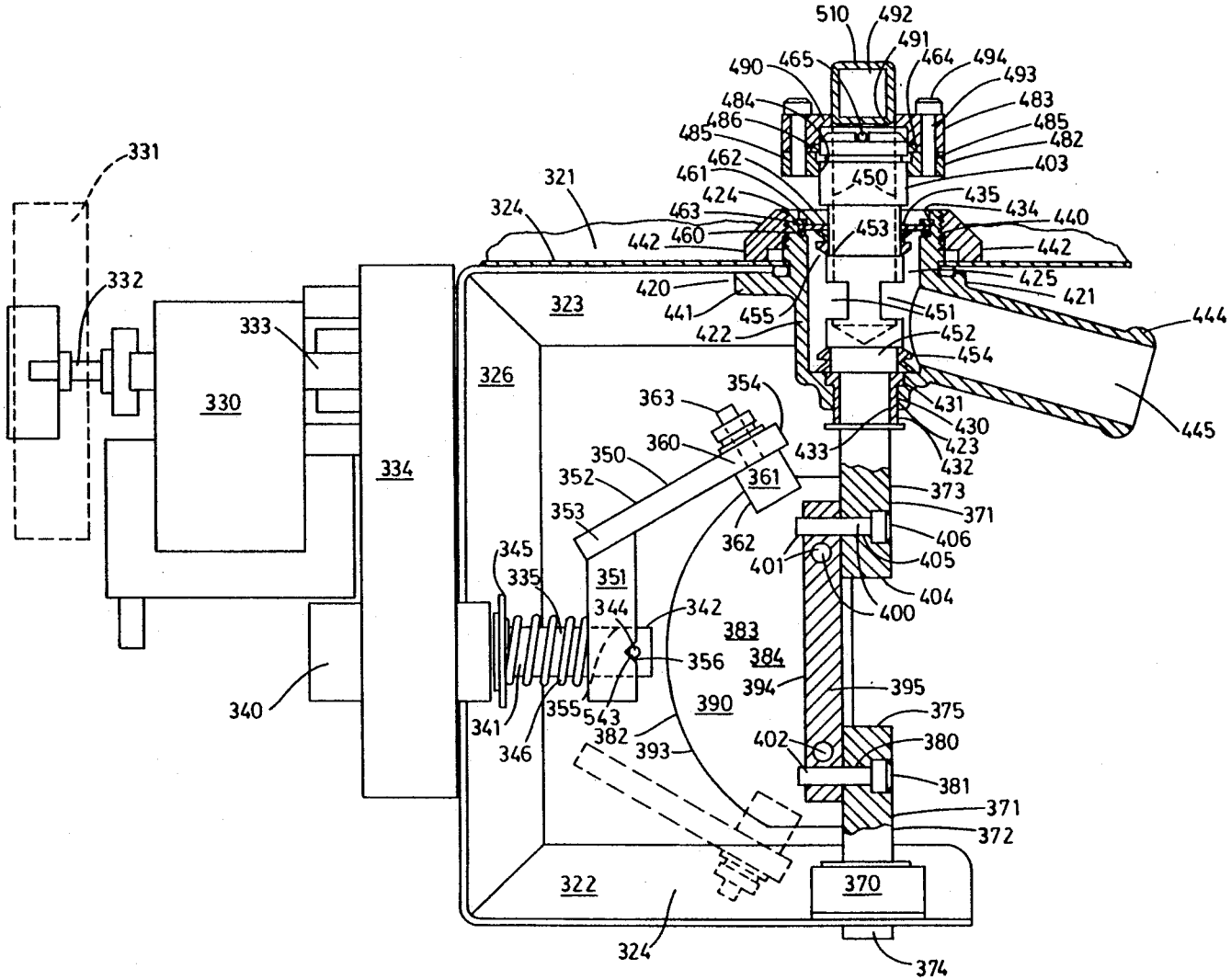
FIG. 9 is a somewhat enlarged, partial, vertical sectional view of the washing apparatus of the present invention and showing the drive mechanism thereof.
Figure 10:
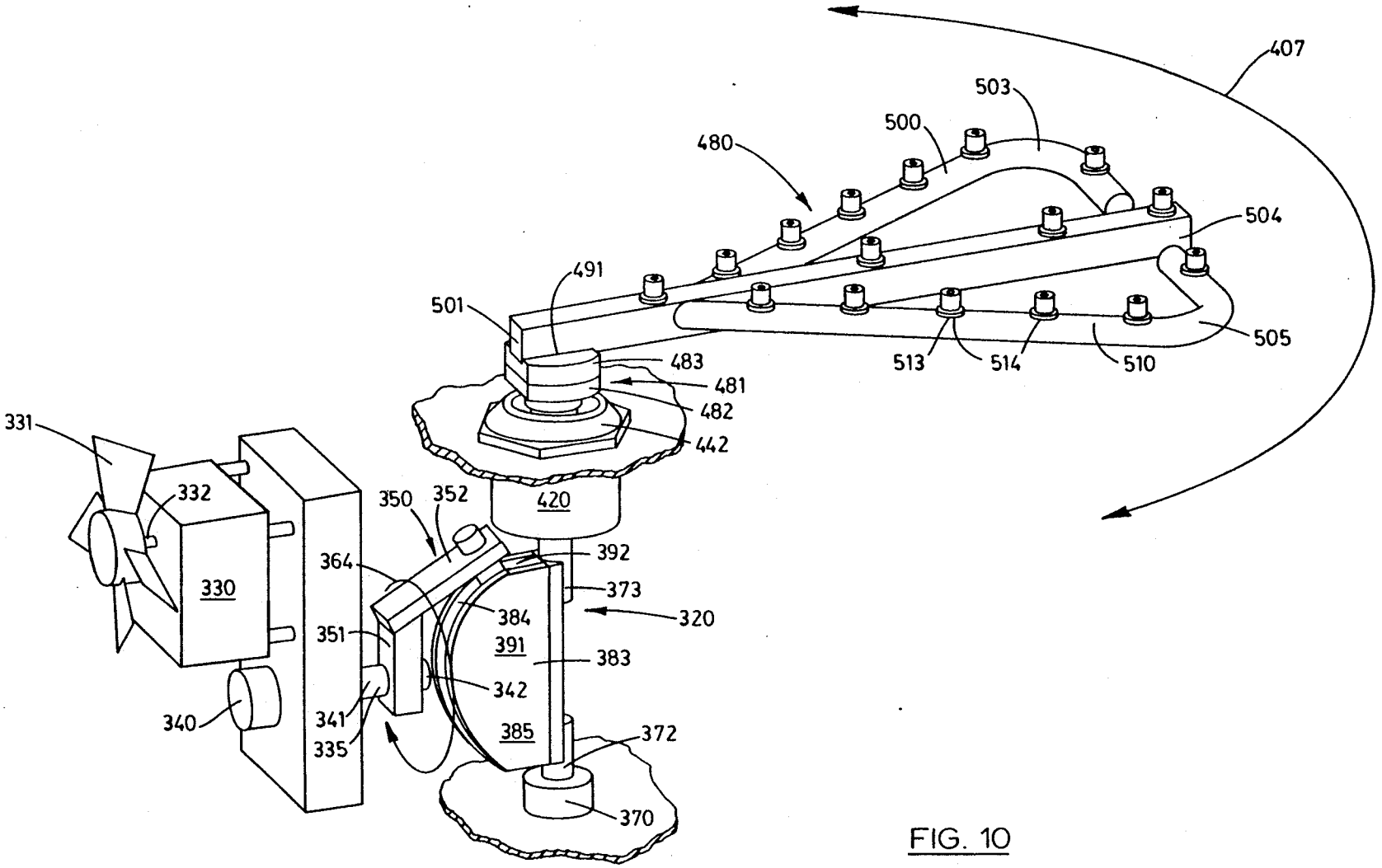
FIG. 10 is a fragmentary, perspective view of the drive mechanism and spray manifold of the present invention.

As best illustrated by references to FIGS. 9 and 10 a bearing assembly, and which is generally indicated by the numeral 370, is affixed using conventional fastening techniques to the supporting surface 324 of the lower leg 322. The bearing assembly 370 is operable to support for rotational movement a drive shaft and which is generally indicated by the numeral 371. The drive shaft 371 includes first and second portions 372 and 373, respectively. The first portion includes a first end 374 which is received in rotatable mating relation relative to the bearing assembly, and an opposite distal second end 375. As best seen by reference to FIG. 9 an aperture 380 of predetermined dimensions is formed in the second end 375 and is disposed substantially transversely thereof. The aperture 380 is operable to receive a fastener 381. Affixed to the drive shaft 371 is a cam and which is generally indicated by the numeral 382. The cam has a main body 383 which includes first and second sidewalls 384 and 385, respectively. The individual sidewalls include inwardly and outwardly facing surfaces 390 and 391, respectively and the inwardly facing surfaces define a space or a channel 392 therebetween. The space or channel 392 has a width dimension that is equal to, or just slightly greater than the diametral dimension of the main body 362 of the cam follower 361 and which is rotatably mounted on the distal end 354 of the drive arm 350. Further, the first and second sidewalls include forwardly and rearwardly facing peripheral edges 393 and 394, respectively. The forwardly facing peripheral edge is best seen by reference to FIG. 9 and is substantially arcuately shaped, and the rearward peripheral edge is substantially straight. The first and second sidewalls are held in predetermined, spaced relationship relative one to the other by a base member 395. As best illustrated by reference to FIG. 9 a plurality of apertures 400 are formed in the base member. The apertures include a first pair of apertures 401 which are operable to receive fasteners, not shown and which secure the individual sidewalls 384 and 385 thereto. Further the second pair of apertures 402 are positioned substantially transversely relative to the first pair of apertures and are operable to receive fasteners thereby securing the cam and the base member to the first and second portions 372 and 373 of the drive shaft 371. The second portion 373 of the drive shaft 371 includes first and second ends 403 and 404, respectively. An aperture 405 of predetermined dimensions is formed in the second portion and is operable to receive a fastener 406 which is slidably received through the coaxial aligned apertures as shown in FIG. 9 thereby securing the cam to the first and second portions of the drive shaft. As best imagined and understood by a study of FIG. 10 the rotational movement of the drive arm 350 about the circular path of movement 364 has the corresponding effect of causing the drive shaft 371 to rotate substantially 120° about its axis thereby moving an associated spray manifold about a substantially arcuately shaped path of travel 407 and which is of substantially the same width. The spray manifold will be discussed in greater detail hereinafter.

A support housing and which is generally indicated by the numeral 420 is positioned in the aperture 325 and which is formed in the upper leg 323 of the supporting frame 321. The support housing 320 is defined by a wall member 422 which has predetermined dimensions and which further has a first end 423 and an opposite second end 424. The wall member 422 defines a chamber 425. As best illustrated by reference to FIG. 9, the wall member 422, at the first end 423 thereof, defines an aperture 430 of predetermined dimensions. Further, and formed into the wall and disposed in substantially circumscribing relation relative to the aperture 430 is a recess 431 which is operable to receive a bronze sleeve and which is generally indicated by the numeral 432. The bronze sleeve further defines an aperture or passageway 433 which extends therethrough. The passageway is operable to rotatably receive the second portion 373 of the driveshaft 371 and support same for rotational movement about its longitudinal axis. This is best illustrated by reference to FIG. 9.

Formed into the wall member 422, at the second end 424 of the main body 421, is a first major recess 434, and a second minor recess 435. Further, and formed in the exterior surface of the main body 421 at the second end 424 thereof is a plurality of screwthreads 440. Positioned substantially intermediate the first and second ends of the main body and made integral therewith is a flange or enlarged portion 441 of predetermined dimensions. As illustrated most clearly by reference to FIG. 10, a threaded fastener 442 is operable to threadably engage the second end 424 of the main body thereby securing the main body in an appropriate attitude relative to the aperture 325 which is formed in the supporting frame 321. In addition to the foregoing, the main body 421 includes a fluid conducting conduit 444 which is made integral therewith and which defines a fluid passageway 445 which is disposed in fluid transferring relation relative to the chamber 425. The fluid passageway 445 is further connected in fluid communication with the first branch 272 of the discharge conduit 271. As most clearly shown by reference to FIG. 9 a substantially longitudinally disposed passageway 450 is formed in the second portion 373 of the drive shaft 371 and is operable to conduct fluid from the chamber to the spray manifold and which will be discussed in greater detail hereinafter. A pair of apertures 451 are formed in the second portion of the drive shaft thereby permitting fluid to enter into the passageway.

The second portion 373 of the drive shaft 371 has formed therein first and second recessed areas 452, and 453, respectively, and which are disposed in substantially circumscribing relation about its exterior surface. Further, first and second seal members 454 and 455, respectively, and which are of conventional design, are mounted in substantially telescoping relation about the second portion of the drive shaft and are received and secured in the recessed areas 452 and 453. The first and second seals are operable to engage the wall member 422 in a fashion whereby fluid entering the chamber is substantially inhibited from exiting same except through the passageway 450. This relationship is shown most clearly by reference to FIG. 9. An 0-ring 460, and which is of conventional design, is received in the first major recess 434. Further, a washer 461 and which defines a passageway 462 is operable to be received about the second portion 373 of the drive shaft 371 and is sandwiched between the 0-ring 460 and a snap ring 463 which is received in the second minor recess 435. The second seal 455 is operable to rest against the washer 461. In this fashion, the second portion of the drive shaft is sealingly secured about the second end 424 of the main body 421. The second portion 373 of the drive shaft 371 further has formed in its exterior surface a third recess 464 which is disposed in substantially circumscribing relation about its outside surface and further a fourth recess 465 is located in the extreme distal end of the second portion 373 and is disposed substantially transversely relative thereto.

As best seen by reference to FIG. 10 a spray manifold and which is generally indicated by the numeral 480 is operable releasably to be affixed to the second portion 373 of the drive shaft 371 and disposed in fluid receiving relation relative to the passageway 450. The spray manifold 480 includes a base member and which is generally indicated by the numeral 481, and which includes first and second portions 482 and 483, respectively. As best illustrated by reference to FIG. 9 a substantially centrally disposed aperture 484 is formed in the first portion and a pair of fastening apertures 485 are positioned in radially offset relation relative thereto. A snap ring 486 is received in the third recess 464 and is operable to inhibit movement of the first portion 482 therealong the second portion 373 of the drive shaft 371.

As best illustrated by reference to FIGS. 9 and 10 the second portion 483 of the base member 481 has a main body 490 which has formed in its exterior surface a channel 491 of a predetermined depth. Further an aperture 492 is disposed substantially centrally of the main body and is disposed in substantially coaxial registery with the aperture 484 which is formed in the first portion 482 thereof. Further a pair of fastening apertures 493 are formed in the main body and are operable to be positioned in substantially coaxial registery with the fastening apertures 485 which are formed in the first portion 482 thereof. A pair of fasteners 494 are operable to be received in the coaxial aligned apertures thereby fastening the first and second portions 482 and 483 together and securing them in a predetermined attitude relative to the second portion 373 of the drive shaft 371.

The spray manifold 480 has a main body 500 which has a first end 501 which is affixed in fluid receiving relation relative to the main body 490 of the second portion 483, and an opposite, second or distal end 502 which is remote thereto. The main body includes first, second and third members which are indicated by the numerals 503, 504, and 505, respectively. As best seen by reference to FIGS. 5 and 10, the second member 504 has a substantially linear shape, and the first and third members are fixed to the second member at a location intermediate its opposite ends. The first and third members are substantially L-shaped and diverge from the second member at an angle of approximately 30°. The first, second and third members each include an upper facing surface 510, and the individual members define a central passageway 511 which is operable to receive the fluid from the chamber 425. The individual members 503 through 505, respectively, have a distal end 512 and a plurality of apertures 513 are formed in predetermined spaced relationship along the upper facing surface 510 thereof. As best illustrated by reference to FIG. 10 a plurality of spray nozzles of substantially conventional design are affixed in mating relation with the individual apertures 513 and are operable to direct fluid received from the passageway 511 into the second void 61 of the housing 12. This relationship is also seen by reference to FIG. 7.

Figure 5:
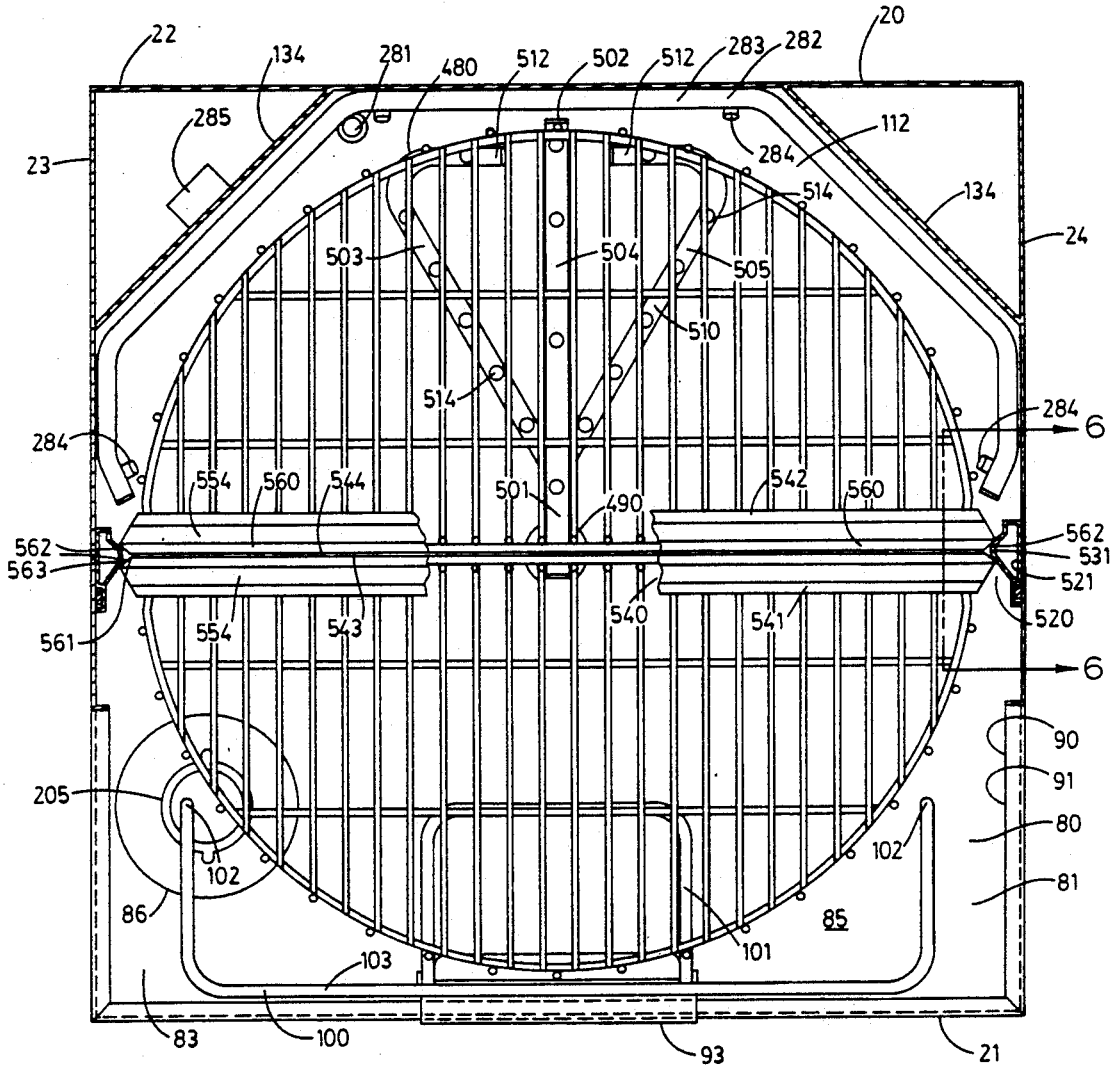
FIG. 5 is a fragmentary, top plan view of the first form of the washing apparatus of the present invention and which is taken from a position along line 5—5 of FIG. 1 and which further has some supporting surfaces removed to show the detail thereunder.
Figure 6:
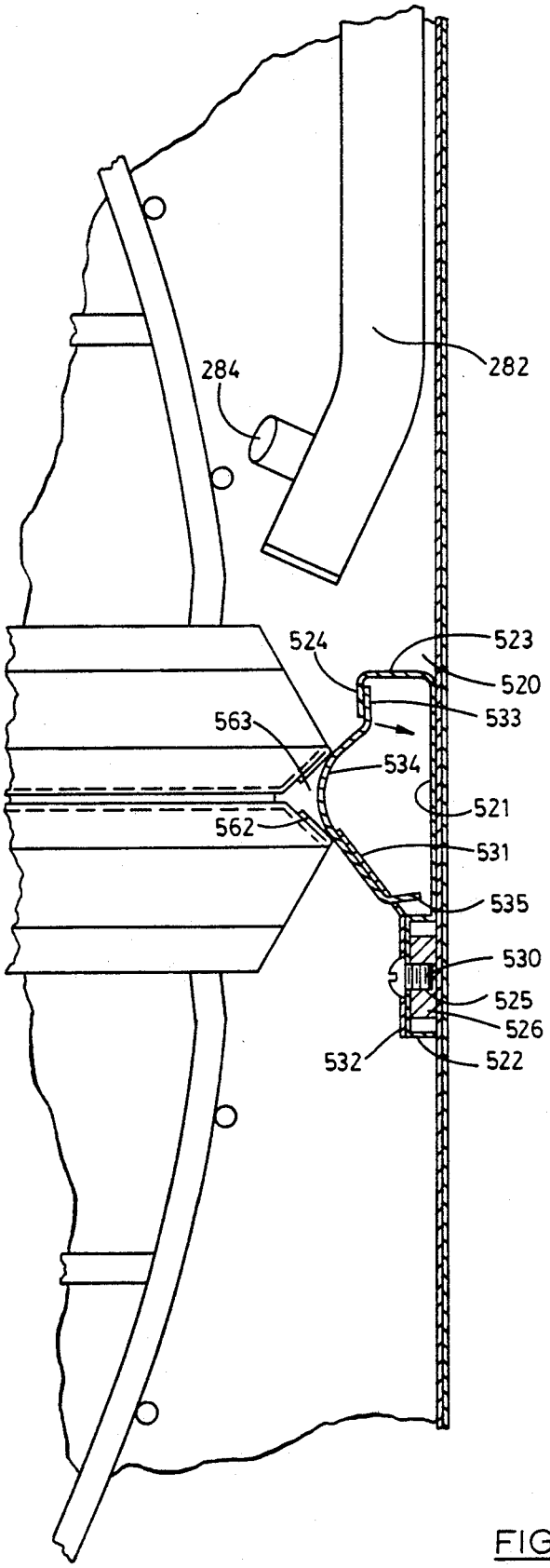
FIG. 6 is a somewhat enlarged, fragmentary, top plan view of the apparatus of the present invention and taken from a position along line 6—6 of FIG. 5.

As best illustrated by references to FIGS. 5 and 6, a pair of sealing members and which are generally indicated by the numeral 520 are affixed in predetermined substantially vertical attitudes on the inside facing surfaces 60 of the left and right sidewalls 51 and 52. As should be understood, the two sealing members are operable to matingly engage a rotatable door or carousel and which will be discussed in greater detail hereinafter. For the sake of brevity, only one of the sealing members is discussed in detail herein, it being understood that both sealing members ar of substantially identical construction.

The sealing members 520 each include a base portion 521 which is affixed to the inside surface 60 of the top portion 13, of the housing 12, and includes a first end 522 and an opposite second end 523. As best illustrated by reference to FIG. 6, the second end has formed therein a flange member 524 and which is operable to engage a spring member which will be discussed below. A threaded aperture 525 is formed in the mounting plate 526 and is operable to receive a threaded fastener 530 of conventional design. A spring member 531 and which is manufactured from a material such as stainless steel has opposite first and second ends 532 and 533, respectively. The first end 532 is affixed to the first end of the base portion by using a suitable fastening technique such as welding or the like. Further the second end 533 is captured or held in a predetermined movement limiting position by the flange member 524. The spring member further includes an arched substantially intermediate portion 534 which is adapted to engage the rotatable baffle or door and which will be discussed in greater detail hereinafter. Further, and as best illustrated by reference to FIG. 6 a movement limiting member 535 is affixed to the spring member 531 and is operable to prevent the movement of the spring towards the inside surface 60 of the left and right sidewalls 51 and 52, respectively. As should be understood the spring is operable to move substantially outwardly or away from the inside surface of the wall thereby engaging the rotatable door and thus releasably securing it in a predetermined substantially occluding position relative to the second void 61. This is illustrated most clearly by reference to FIG. 5.

As best understood by a study of FIGS. 3, 4 and 5, a rotatable door, baffle, or carousel and which is generally indicated by the numeral 540 is mounted for substantially rotational movement relative to the top portion 13 of the housing 12. The rotatable door includes first and second portions 541 and 542, respectively, and which are fixed together using a suitable fastening technique such as welding or the like. The first and second portions each have forwardly, or outwardly facing surfaces 543 and opposite, inwardly facing, or rearwardly disposed surfaces 544. Further the first and second portions 541 and 542 have a peripheral edge 545. As should be understood the peripheral edges include top and bottom portions 550 and 551, respectively, and left and right peripheral edges 552 and 553, respectively. As best understood by a study of FIGS. 3 and 5, edge members which are substantially cup-shaped 554 are affixed or made integral with the top peripheral edges 550. The edge members define a draining channel 560 of predetermined dimensions. As should be understood the draining channel is operable to collect fluid, such as water, which is sprayed inside the second void 61 by the spray manifold 480 and thereby collect same and drain the water to the left and right peripheral edges of the rotatable door 540. Further, and as best seen by reference to FIG. 6, the rotatable door includes two pairs of flared edge members 561 which are individually positioned in outwardly facing relationship relative one to the other, and which define a V-shaped channel or gap 563. As should be understood the V-shaped gap 563 is operable to receive the arched, intermediate portion 534 of the spring member 531 as shown in FIG. 6. As should be understood, and when the door is rotated, the flared edge members 562 are operable to depress the spring thereby allowing the door to rotate past the spring. However, and when the door is in an occluding position relative to the second void 61, the intermediate portion of the spring is operable to be received in the V-shaped gap thereby releasably securing the door in the occluding position. As best understood by a study of FIG. 3, three support brackets 564 are fixed in predetermined spaced relationship on the forwardly facing surfaces 543 of the first and second portions 541 and 542, respectively. The individual support brackets are operable to support a foraminous container which will be discussed in greater detail hereinafter.

Figure 7:
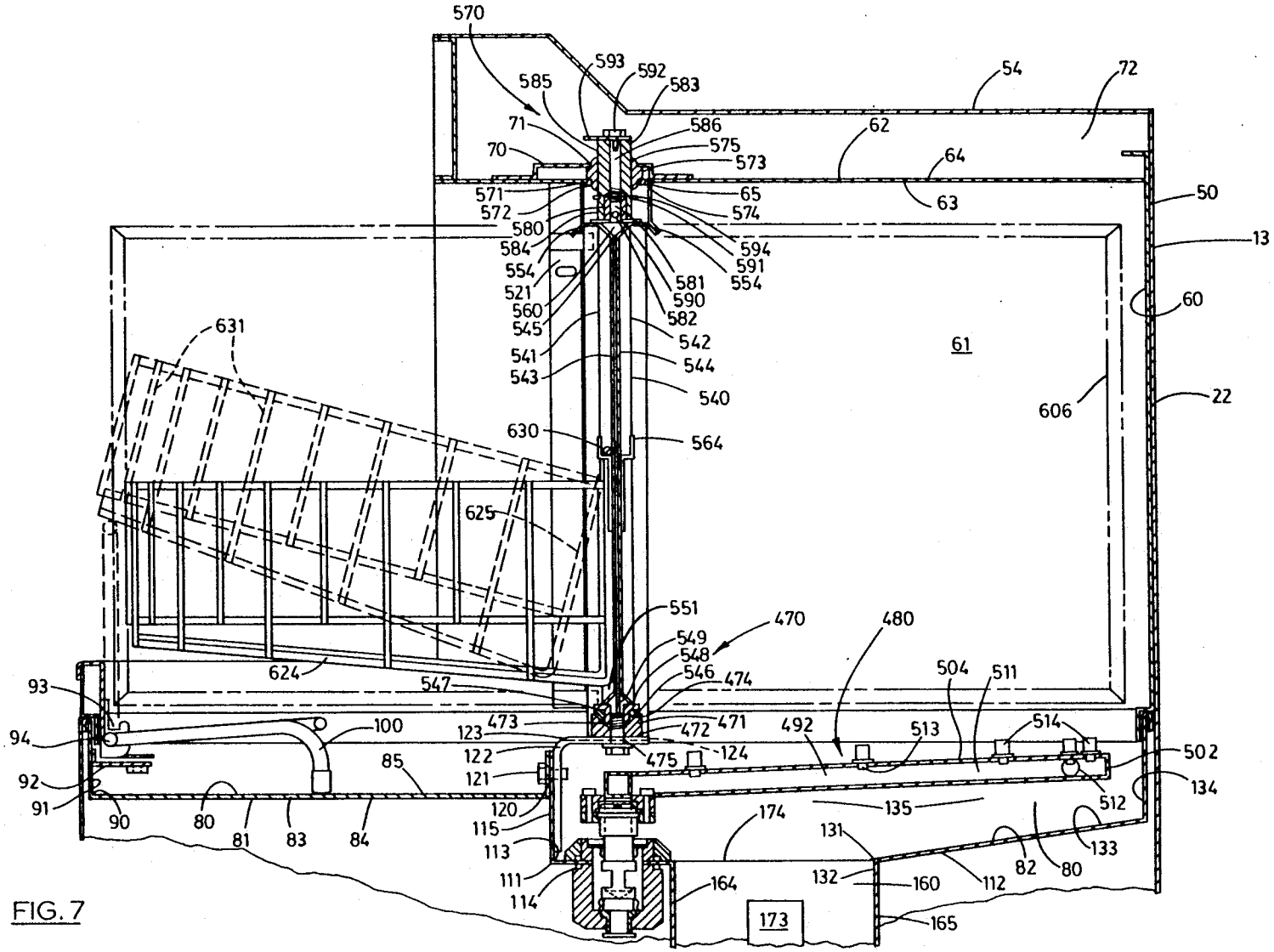
FIG. 7 is a fragmentary, longitudinal, vertical sectional view of the washing apparatus of the subject invention and taken from a position along line 7—7 of FIG. 1.

As best understood by a study of FIG. 7, the rotatable door or carousel 540 is supported for rotational movement relative to the top portion 13 of the housing 12 by means of a pair of substantially coaxially aligned rotational support members, and which are generally indicated by the numeral 470. The bottom rotational support member, and which is generally indicated by the numeral 471, includes a base member 472 which is disposed in rested receipt on the upper supporting surface 123 of the supporting L-shaped bracket 122. The base member 472 has an upper facing surface 473 which has a substantially truncated or frusto-conically shaped receiving station 474 formed therein. Further and disposed substantially centrally thereof and positioned in substantially coaxial registery with the U-shaped channel or slot 124 formed in the supporting L-shaped bracket 122 is a threaded aperture and which is generally indicated by the numeral 475. Disposed in rested, substantially mating receipt relative to the receiving station 474 is a tapered bearing 546, and which is of conventional design. The tapered bearing 546 has an aperture or channel formed substantially centrally thereof and which is positioned in substantially coaxial alignment relative to the threaded aperture 475. Affixed to the bottom peripheral edge 551 of the rotatable door 540 is a sleeve member 548 which has formed therein a passageway 549 of predetermined dimensions. The sleeve 548 is operable to be telescopingly received in the passageway 549 and is thereby rendered operable for rotational movement relative to the tapered bearing 546. A threaded fastener is threadably received in the threaded aperture 565 and thereby secures the base portion in a substantially fixed position relative to the L-shaped bracket 122. As should be understood, the door rests on the tapered bearing and is operable for rotational movement therewith.

The rotatable door or carousel 540 includes a top rotational support member and which is generally indicated by the numeral 570. The top rotational support member is sealingly secured in place by means of a rubber gasket 571 which is disposed in partially occluding relation relative to the aperture 65 and which is formed in the ceiling member 62. The rubber gasket has formed substantially centrally thereof, an aperture 572 of predetermined dimensions. The rubber gasket is operable to sealingly receive a nylon gasket and which is operable to be sandwiched or otherwise captured therebetween the ceiling member 62 and the support bracket 70 and which further is disposed in substantially coaxial alignment relative to the apertures 65 and 71, respectively. This relationship is shown clearly in FIG. 7. The nylon gasket has formed in its exterior surface a substantially circumscribing groove or recess 574 and which is adapted to receive and sealingly mate with the rubber gasket 571. Further, and formed substantially longitudinally thereof, and extending therethrough, is a centrally disposed channel or aperture 575 of predetermined dimensions.

The top rotational support member 570 includes a base member 580 and which is affixed on the top peripheral edge 550 of the rotatable door or carousel 540. The base member has formed substantially centrally thereof a threaded channel 581. Further and extending substantially radially outwardly relative to the base member is a pair of arm members 582. A sleeve, and which is generally indicated by the numeral 583, is operable to be telescopingly received over the base member 580. The sleeve, which has first and second ends 584 and 585 and which has formed substantially centrally thereof a longitudinal passageway 586, has a diametral dimension which is slightly greater than the outside diameter of the base member 580. Formed in the first end of the sleeve 583 are a pair of longitudinally oriented channels 590 and which are individually operable to mate with or slideably receive each of radially disposed arms 582. As should be understood, and when the door is rotated about its axis, the base member causes the accompanying sleeve 583 to rotate in substantial unison therewith. Formed in the exterior surface of the sleeve 530 is a substantially circumscribing groove 591 and which is disposed intermediate the first and second ends 584 and 585, respectfully. A threaded fastener 592 is operable to be received in the longitudinally disposed passageway 586 and is received in threadable mating receipt in the threaded channel 581 which is formed in the base member 580. The threaded fastener 592 is operable to secure for rotational movement therewith, a switch actuation arm and which is generally indicated by the numeral 593 (FIG. 3). As best illustrated by reference to FIG. 7 a snap ring 594 is operable to be received in the circumscribing groove 591 and is operable to prevent the assembly from being pulled upwardly thereby dislodging the door from the bottom support member which was discussed earlier.

As best illustrated by reference to FIG. 3, the switch actuation arm 593 has a main body 600 which includes opposite first and second ends 601 and 602, respectively. Further, and as best illustrated by reference to FIG. 3 and 7, an electrical switch 603 and which is of substantially conventional design, is fixed on the support bracket 70. As earlier discussed, the support bracket is affixed to the ceiling member 62. The electrical switch is designed when placed in a closed position to permit the control assembly, not shown, to activate the various subassemblies of the present invention including activating the pump 261, spray manifold 480 and oscillating drive mechanism 320 and which were discussed in greater detail earlier in this application. It should be understood, therefore, that the rotatable door 540 must be disposed in a substantially blocking or occluding position relative to the second void 61 to permit further operation of the apparatus 10 such as activation of the oscillating drive assembly. This feature, of course, prevents the apparatus 10 from operating at any time when the door is disposed in any position other than the blocking or occluding position. The door is operable for movement along substantially circular path of travel from an occluding position 605 to a second occluding position and wherein the foraminous container mounted on the door is disposed in the second void 61.

As best understood by reference to FIGS. 1 and 3 the apparatus 10 includes a pair of foraminous containers 620 and which are operable to be releasably supported by the support brackets 564, and disposed in spaced relation relative to the first draining pan 81. The support brackets are further adapted to support the foraminous containers in an appropriate position relative to the second void 61 such that the spray manifold may deliver a mixture of water and chemicals to the vessels to be washed and sanitized in the fashion which will be discussed in greater detail hereinafter. The individual foraminous containers 670 include first and second containers 621 and 622, respectively, and which are individually releasably mounted on the first and second portions 541 and 542 of the rotatable door 540 and which are disposed in spaced relation relative to the first and second draining pans 81 and 82, respectively. The first and second foraminous containers each have a main body 623 which includes an inclined or bottom surface 624 and which is operable to position the glasses or vessels to be processed (not shown) in an advantageous draining attitude relative to the respective draining pans. The individual foraminous containers further have a rearwall 625 which extends upwardly from the bottom surface and which includes a top peripheral edge 630 and which is engaged and supported by the support brackets 564 which were discussed earlier. Further, the individual foraminous containers have a semicircular shape which is defined by an outside or arcuately shaped sidewall 631 and which is fixed on or to the rearwall, and which is further made integral with or affixed to the inclined bottom surface 624. The individual foraminous containers are operable to move along a path of travel 632 from a first position 633 wherein they are located in spaced relationship relative to the first draining pan 81, to a second position 634, and wherein they are disposed in spaced relationship relative to the second draining pan 82. As should be understood the individual foraminous containers provide a convenient means by which the apparatus 10 can be quickly loaded and unloaded after the various glasses have been washed and sanitized and also provides a means by which the containers can be rapidly moved from one location to another utilizing various transportation mechanisms which are well understood by those skilled in the art.

The apparatus 10 of the present invention includes a control means having an electric circuit, not shown, and which is operable to connect, in signal receiving relation, the various electrical components such as the power switch 74, stop switch 75, drain valve 193, oscillating drive mechanism 320, chemical pumps 290 and the solenoid for controlling water intake 300 and the run capacitor 301. As should be understood, the control assembly is operable to assure that the rotatable door is in a substantially blocking or occluding position relative to the housing 12 and further provides a means for coordinating the intake of water and chemicals to the primary tank 160. The control assembly also provides various visual signals by means of the indicating lights 77 which were earlier discussed, and which may signal an operator that the chemical pumps 290 are not pumping or supplying the desired chemicals to the primary tank. In addition to the foregoing, the control assembly coordinates the operation of the various subassemblies of the apparatus such that the operation of the oscillating drive mechanism is coordinated with the supply of water to same, such that, when the apparatus 10 of the present invention is draining or when the door 540 is disposed in other than the blocking or occluding position, the oscillating drive mechanism is deactivated. Further, the control assembly provides a timing function for the apparatus 10 whereby the various subassemblies perform functions of predetermined duration and in a predetermined sequence. The control means is of substantially conventional design and therefore for the sake of brevity is not discussed in significant detail herein. However, FIG. 17 discloses the various sequences and intervals of time that the control assembly provides for controlling the various functions of the present apparatus 10 and one skilled in the art will readily recognize how same may be accomplished by the control assembly.

Second Form Of The Invention

Figure 2:
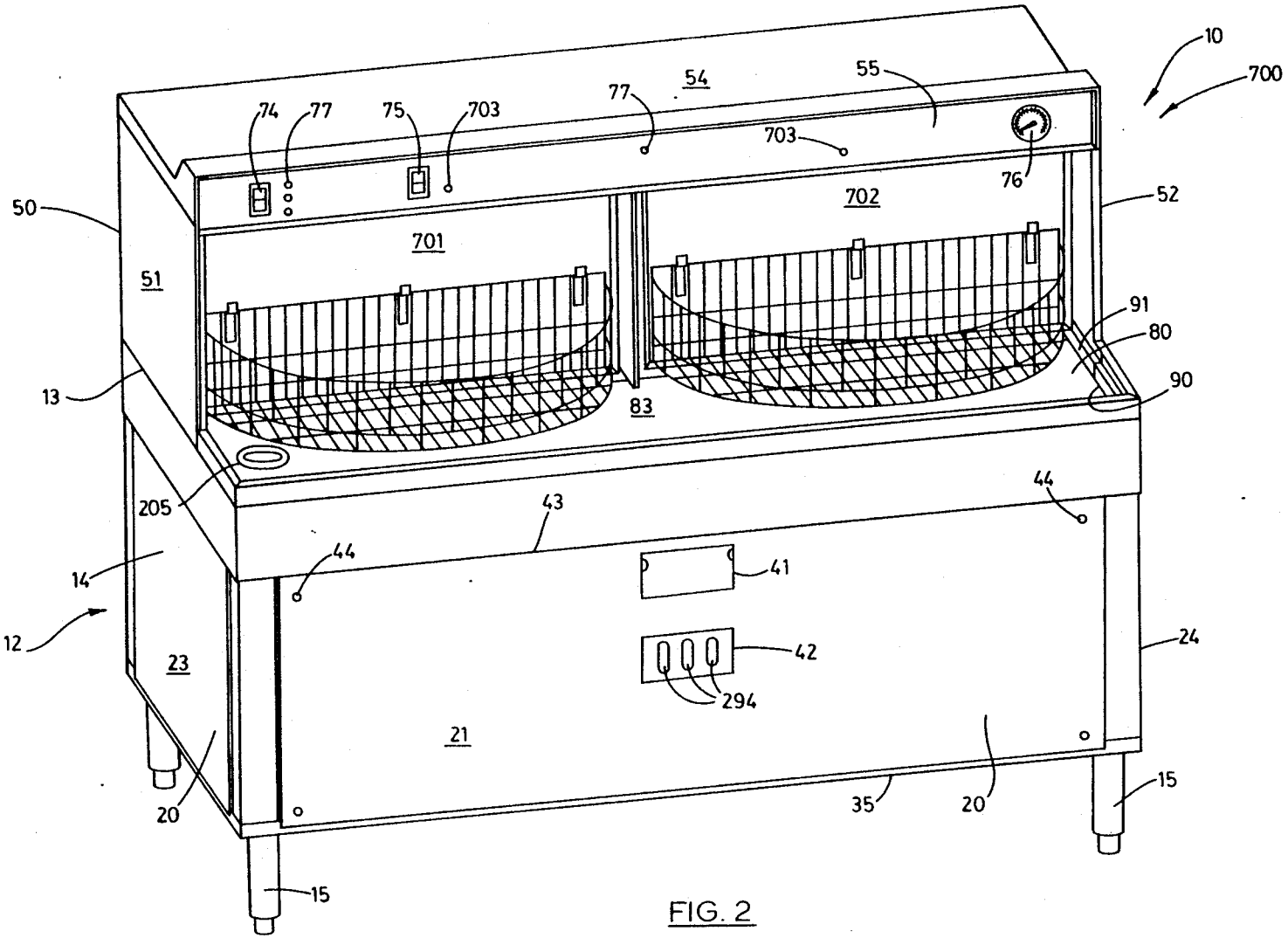
FIG. 2 is a perspective, front elevation view of the second form of the washing apparatus of the present invention and which is shown in a typical operational environment.

The second form of the present invention is generally indicated by the numeral 700 in FIG. 2.

As shown therein the apparatus of the subject invention includes first and second washer assemblies 701 and 702, respectively, which are positioned in side-by-side relation, and which are enclosed within the housing 12. As should be understood, and in this "tandem model", various subassemblies which render operable the first and second washer assemblies are substantially duplicated. More particularly, the earlier identified oscillating drive mechanism 320, are mounted in pairs in the apparatus 700 and are individually adapted to service each of the washer assemblies. However, it should be understood that the second form of this invention will share the same chemical pumps 290, drain valve 193; pump 261; primary tank 160 and control means. In operation the first and second washer assemblies will run substantially simultaneously thereby doubling the capacity of the apparatus 10. In all other aspects the second form of the invention is structured and functions substantially identically to that which was discussed earlier with respect to the first form of the invention 10 with the exception noted below. It should be recognized, however, that the second form of the invention could be rendered operable to function in a manner whereby the individual washer assemblies may be individually actuated by the operator, as desired. Further the second form of the invention includes a means whereby the operator, not shown, may determine which washer assembly has completed its cycle. In this regard the second form of the invention includes cycle complete indicator lights 703 which individually signal when the processing cycle of the individual washer assemblies is complete.

Figure 16:
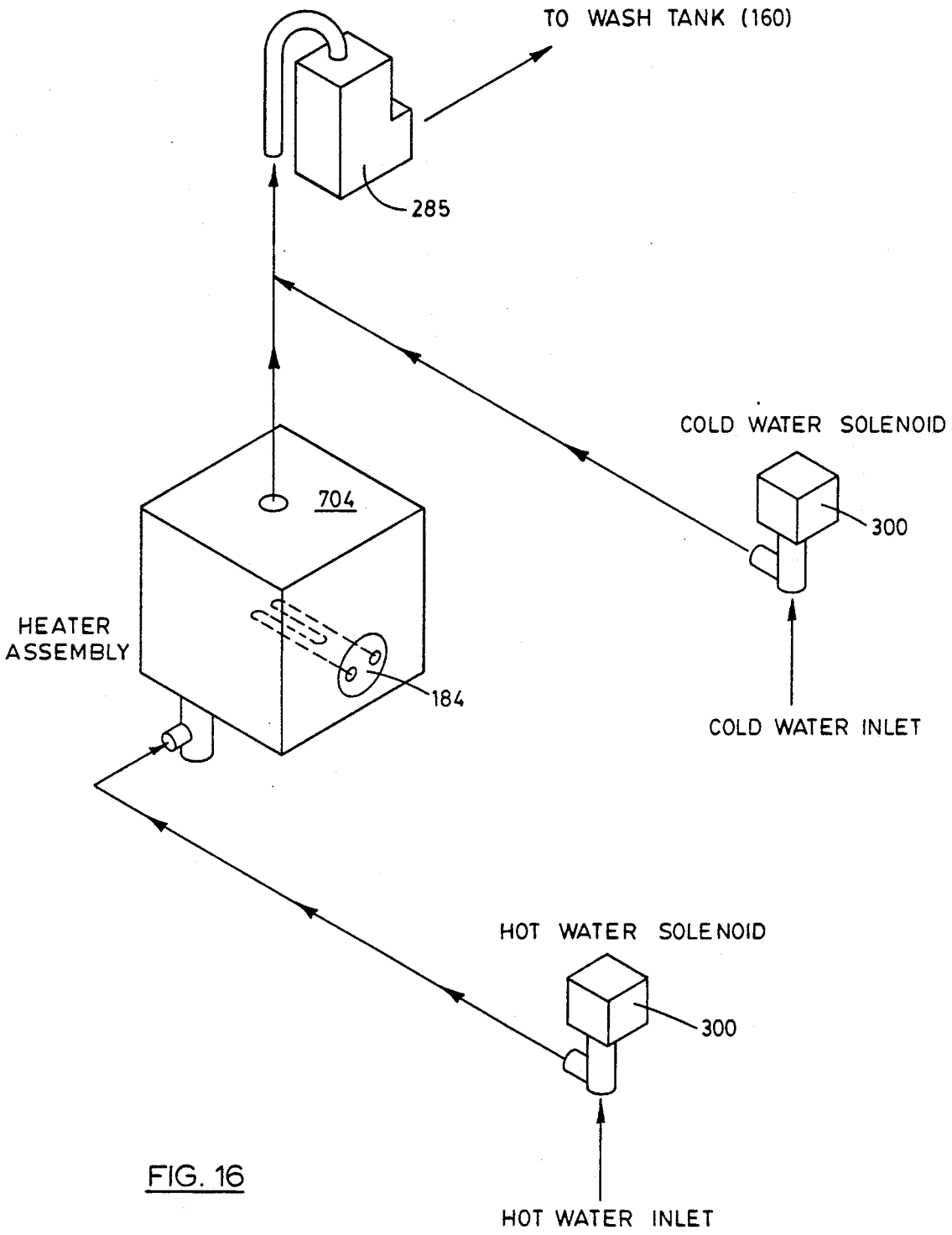
FIG. 16 is a schematic representation of the washing apparatus of the present invention, and more particularly the hot and cold water system thereof.

It should be understood that the apparatus 10 and 700 of the subject invention includes both a cold water rinse design and a hot water rinse design. In this regard the cold water rinse design is schematically represented in FIG. 16. The apparatus 10 or 700 is operable upon cycling to rinse the glasses or other vessels being processed in the second void 61 with ambient temperature water. Further the cold water rinse device has an auxiliary heater assembly 704 and which is operable to provide 140° F. water for use during the wash cycle. Upon completion of the rinse cycle the rinse water is expelled from the apparatus. Alternatively, it should be understood that with respect to the hot water rinse design, the hot rinse water is retained or collected in the primary tank following the rinse cycle and new chemicals are added to the rinse water thereafter. This rinse water, with chemicals, is then used in the subsequent, or next immediate processing cycle. As earlier discussed, the various predetermined cycles, and durations of time for each cycle, is set forth in FIG. 17 for the hot water rinse design noted above. The cold water rinse design would have substantially similar characteristics with the exception of the cycle relating to draining the wash tank following the rinse cycle.

Operation

The operation of the described embodiments of the present invention are believed to be readily apparent and are briefly summarized a this point.

As should be understood, the apparatus of the subject invention has first and second forms 10 and 700, respectfully, however, operation of these two forms of the invention are substantially identical and therefore for the sake of brevity the operation of the first form of the invention is only discussed herein, it being understood that the operation of the second form of the invention is substantially identical.

As best illustrated by reference to FIG. 4 the washing apparatus 10 of the present invention and which is operable to supply a cleansing fluid to an object of interest such as a plurality of glass vessels, not shown, includes a housing 12 for enclosing the apparatus 10 and which includes a first staging area which is defined by the first draining pan 80, and a washing area wherein the vessels are washed, rinsed and sanitized, and which is defined by the second void 61. A carousel 540 is rotatably borne by the housing and is operable to carry an object of interest such a glass drinking vessel, not shown, by means of a foraminous container 640 between the first and second areas. A spray manifold 480 is rotatably borne by the housing and is operable for oscillating movement along a path of travel 407 which is disposed in the washing area. Means are borne by the housing for selectively supplying the cleansing fluid to the manifold. In this regard a pump 261 is connected in fluid communication with the primary tank 160 and is operable to supply the spray manifold with the mixture of chemicals and water supplied to the primary tank. A drive mechanism 320 is borne by the housing and is operable drivingly to engage the manifold and move it along the path of travel 407 thereby causing the oscillating motion of the spray manifold. Further a means for selectively controlling the supplying means and the drive mechanism is provided whereby the supplying means and the drive mechanism can be activated when the carousel is in a predetermined position relative to the staging area and the washing area. As earlier discussed the carousel must be positioned in a substantially occluding or blocking position relative to the second void 61.

Figure 17:
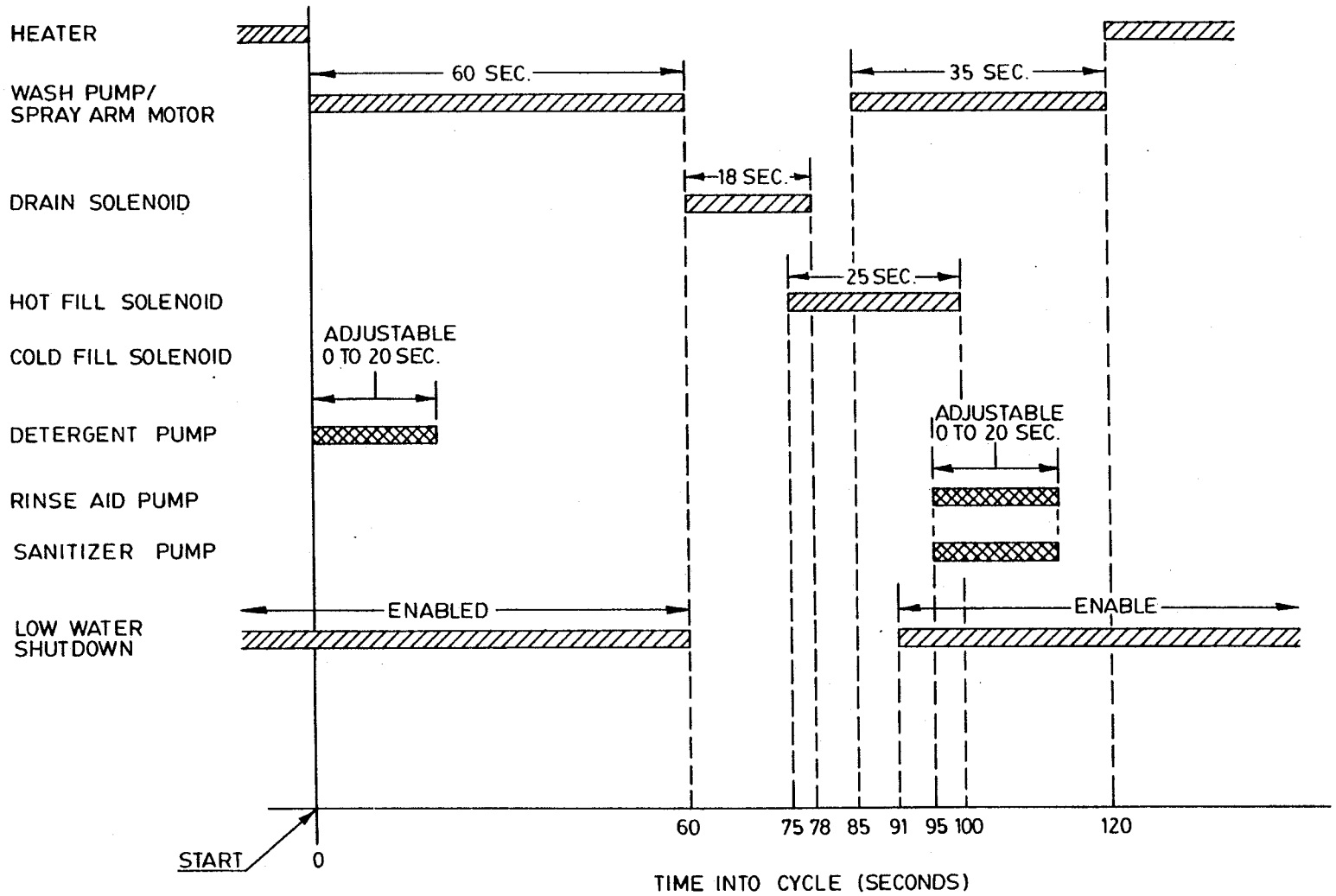
FIG. 17 is a schematic representation of the various sequences and intervals of time that the control assembly provides for controlling the various subassemblies and functions of the present invention.

The carousel 540 is operable to releasably secure a pair of foraminous containers 620. The individual foraminous containers are adapted to support the vessels to be processed in spaced relation relative to the first and second drain pans 80 and 81 respectively. As best seen by reference to FIG. 4, and as earlier discussed, to facilitate operation of the present apparatus 10 an electrical switch 603 is provided and which is actuated by a switch actuation arm 593 and which is made integral with the carousel. As earlier discussed, and when the carousel is disposed in a substantially occluding or blocking position relative to the housing 12, the control assembly is rendered operable to activate the various subassemblies of the present apparatus for the predetermined durations of time which are shown in FIG. 17 to permit the selective delivery of chemicals 291 and water from the primary tank through the spray manifold 480 and to the glasses which are supported by one of the foraminous containers 620. As earlier discussed the spray manifold moves along a predetermined and substantially arcuately shaped path of travel 407 in the second void 61 and delivers washing and rinsing water, and chemicals to the vessels. Further the apparatus includes an upper spray manifold 282 which is also operable to deliver a mixture of chemicals and water to the vessels which are located in the second void 61.

As should be understood, the water which is delivered to the primary tank 160 enters into the sump tank 180 and is then filtered through the filtering assembly 220. After filtering, the water enters into the pump 261. The pump 261 is operable, thereafter, to supply the mixture of water and chemicals to the upper fixed, spray manifold and the moveable spray manifold 480 as discussed earlier. Upon completion of that portion of the cycle which includes the application of detergent to the vessels, the drain valve 193 is operable to release the used mixture of water and detergent from the primary tank and associated sump tank and expel it to the ambient environment.

To prepare for the processing cycle, soiled glasses or other vessels, not shown, are placed in an appropriate downward facing position in the foraminous container 620 which is disposed in the first staging area 81, and then the operator rotates the carousel 540 along the path of travel 632 such that the loaded foraminous container is positioned in the second void or washing area 61. Upon positioning the rotatable door or carousel in an appropriate occluding or blocking position relative to the second void 61, the operator then presses the start button 75 which initiates the processing cycle. Upon completion of the processing cycle the operator rotates the door along the path of travel 632 and back to a position whereby the cleaned and sanitized glasses or vessels may be removed from the foraminous container. As earlier discussed, an elevating assembly 100 is provided and which provides a means by which the foraminous container may be placed in an advantageous draining position as best shown by reference to FIG. 4.

The washing apparatuses 10 and 700 includes a filtering assembly 220 which has a foraminous main body 221 which is defined by interior and exterior surfaces 223 and 224, respectively. As discussed earlier, and on occasion, various foreign materials such as paper, may be accidentally introduced into the apparatus and then, these same materials become particulate matter which is suspended in the water. The filtering assembly is operable to remove this particulate matter. However, and when the filtering assembly becomes clogged with particulate matter the filtering assembly is operable to draw the ambient atmosphere through the space or passageway 225 thereby rendering the pump 261 substantially incapable of pumping any further fluid. Following completion of the processing cycle or alternatively on command of the operator, the drain valve is activated, and the act of draining the primary tank 160 and associated sump tank 180 has the overall effect of removing the particulate matter which has become lodged on the inside surface of the filtering assembly. Thus, the particulate matter is expelled out of the apparatus 10 and into the ambient environment This feature, of course, greatly facilitates the operation of the present apparatus 10 and 700 inasmuch as it removes the possibility of operator error in cleaning the filtering assembly, and further prevents the particulate matter from clogging or otherwise damaging the pump 261 and spray manifold 480. As earlier discussed the present invention includes hot rinse and cold rinse models which are individually operable to deliver hot water, and ambient temperature water respectively during the rinse portion of the processing cycle. As earlier discussed, and with respect to the cold rinse model, following completion of the processing cycle, the used rinse water is expelled from the apparatus. However, and with respect to the hot rinse model, the hot rinse water is retained in the primary tank following the completion of the processing cycle and new chemicals are added thereto. This water is then used in the next immediate processing cycle.

Therefore the apparatus 10 of the present invention can be employed in a wide variety of industrial environments, can be manufactured and purchased at a moderate cost when compared with related prior art devices, is highly efficient in operation and is compact, thereby facilitating installation and maintenance, and further reduces to an absolute minimum the problems associated with many other prior art devices which are designed for substantially identical purposes.

Although the invention has been herein shown and described in what is conceived to be the most practical and preferred embodiment, it is recognized that departures may be made therefrom within the scope of the invention which is not to be limited to the illustrative details disclosed.

Having described my invention what I claim is new and desire to secure by letters patent is:

1. A washing apparatus for supplying a cleansing fluid to an object of interest comprising:

a housing for enclosing the apparatus and including a staging area, and a washing area, and wherein the housing defines a chamber including an upper portion, and a lower portion which defines a primary tank and a sump tank which receives the cleansing fluid, and wherein the staging area is located in a position exterior to the chamber;

a carousel rotatably borne by the housing and operable to carry the object of interest between the staging and washing areas, and wherein the carousel includes a door which is rotatable about a substantially vertically disposed axis and which has first and second surfaces, the rotatable door operable to support the object of interest in the upper portion of the chamber when the carousel is disposed in the washing area;

means for sealing the rotatable door borne by the housing and which is operable to engage the rotatable door thereby substantially inhibiting movement of cleansing fluid between the staging area and the washing area;

a pair of foraminous containers individually releasably mounted on the first and second surfaces of the rotatable door and wherein the rotatable door is operable for movement from a first position, wherein the pair of foraminous containers are individually positioned in the staging and washing areas, respectively, and the rotatable door is disposed in a substantially occluding position relative to the staging and washing areas, respectively, to an alternate second position wherein the respective foraminous containers are positioned in a location substantially 180 degrees removed therefrom;

a spray manifold rotatably borne by the housing and operable for oscillating movement along a path of travel which is disposed in the washing area, and below the foraminous containers when the individual foraminous containers are positioned in the washing area, means borne by the housing, for elevating the individual foraminous containers when they are disposed in the staging area, the elevating means positioning the individual foraminous containers in a draining attitude relative to the staging area;

means borne by the housing for selectively supplying the cleansing fluid to the spray manifold, the supplying means including valve means and first and second pumps, and wherein the valve means and the first pump are individually operable to selectively deliver predetermined quantities of cleansing fluid which includes water and chemicals, respectively, to the primary tank, and wherein the second pump is operable to selectively withdraw the mixture of water and chemicals from the sump tank and supply it to the spray manifold;

a drive mechanism borne by the housing and operable to cause the oscillating movement of the spray manifold along the path of travel;

a drain valve disposed in fluid draining relation relative to the sump tank, and a filtering assembly is positioned in the sump tank, and wherein the filtering assembly includes a foraminous main body having a wall member which includes an inside surface and an outside surface, and wherein the inside and outside surfaces are disposed in predetermined spaced relation one to the other thereby defining a passageway, and wherein the passageway defined by the inside and outside surfaces is connected in fluid communication with the ambient atmosphere, and wherein the filtering assembly is operable to substantially remove particulate matter from the mixture of water and chemicals resident in the sump tank thereby preventing the particulate matter from traveling to the spray manifold, and wherein the second pump is operable, when the filtering assembly becomes clogged with particulate matter, to draw the ambient atmosphere through the passageway thereby rendering the second pump inoperable; and means for selectively controlling the supplying means and the drive mechanism whereby the supplying means and the drive mechanism can be activated when the carousel is in a predetermined position relative to the staging and washing areas, and wherein the controlling means is further operable to actuate the drain valve thereby draining the primary tank and the sump tank when the second pump is rendered inoperable following the clogging of the filtering assembly, and wherein the draining of the primary and sump tank has the effect of removing the particulate matter which has become lodged in the filtering assembly.

2. A washing apparatus as claimed in claim 1 and wherein the valve means for delivering predetermined amounts of water to the wash tank includes a water inlet solenoid, and wherein the second pump is operable to deliver a mixture of water and chemicals from the sump tank and deliver it to the spray manifold, and wherein the first pump is operable to deliver predetermined amounts of chemicals to the wash tank for mixture with the water.

3. A washing apparatus as claimed in claim 2 and wherein the drive mechanism includes a motor, a gear reduction assembly disposed in power receiving relation relative to the motor, a first drive shaft made integral with the gear reduction assembly, a drive arm having proximal and distal ends and wherein the proximal end is fixed on the first drive shaft and wherein the drive arm extends substantially radially outwardly therefrom, a cam follower fixed on the distal end of the drive arm, a second drive shaft disposed in driving relation relative to the spray manifold, and wherein the second drive shaft has a main body which has formed therein a passageway which connects the manifold in fluid communication with the second pump, and wherein a cam is fixed on the main body of the second drive shaft and extends substantially radially outwardly therefrom, and wherein the cam has a main body which defines a cam passageway and wherein the cam passageway is conformably dimensioned to receive the cam follower, and wherein the rotational movement of the first drive shaft by the motor causes a corresponding oscillating movement of the second drive shaft and the manifold which is fixed thereto.

4. A washing apparatus as claimed in claim 3 and wherein the spray manifold includes first, second, and third members and wherein the first and third members are connected in fluid receiving relation with the second member and diverge from the second member at approximately 30 degrees, and wherein the spray manifold moves along a path of travel which is substantially horizontally disposed and positioned in the washing area and below the foraminous container when the foraminous container is disposed in the washing area, and wherein the path of travel of the spray manifold is substantially 120 degrees wide.

5. A washing apparatus as claimed in claim 4 and wherein the controlling means defines a cold rinse cycle which has a first phase which includes delivering predetermined amounts of water and chemicals to the primary tank; a second phase which includes the removal of the mixture of water and chemicals from the primary tank by the second pump and the delivery of same to the spray manifold for subsequent discharge into the washing area; a third phase which includes the draining of the mixture of water and chemicals from the primary tank and sump tank, adding rinse water to the primary tank, and the withdrawal of the rinse water, from the primary tank by the second pump and the delivery of the rinse water to the spray manifold for subsequent discharge into the washing area; and a fourth phase which includes the draining of the rinse water from the primary and sump tanks.

6. A washing apparatus as claimed in claim 4 and wherein a heater is mounted in the sump tank and is operable to transmit heat energy to the water and chemicals delivered to the primary and sump tanks, and wherein the controlling means defines a hot water rinse cycle which has a first phase which includes delivering predetermined amounts of water and chemicals to the primary tank; a second phase which includes the removal of the mixture of water and chemicals from the primary tank by the second pump and the delivery of same to the spray manifold for subsequent discharge into the washing area; a third phase wherein the mixture of water and chemicals are drained from the primary and sump tanks, and rinse water is delivered to the primary tank and then withdrawn from the sump tank by the second pump and delivered to the spray manifold for subsequent discharge into the washing area; and a fourth phase wherein the rinse water is retained in the primary tank for use in the next immediate wash cycle and wherein in the next immediate hot water wash cycle, the chemicals are delivered to the wash tank and mixed with the rinse water of the previous wash cycle.

7. A glass washing apparatus for supplying a cleansing fluid to soiled glasses comprising:

a housing including a staging area and a washing area, and wherein the glasses to be washed are placed in the staging area and are adapted to moved along a substantially horizontally disposed and arcuately shaped path of travel into the washing area, and wherein the staging are is defined by a drain pan operable to drain the cleansing fluid which includes water and chemicals away from the glasses, and wherein the housing further includes a draining assembly which is operable to conduct the water and chemicals away from the glasses to be washed when they are disposed in the washing area, and wherein the draining assembly includes an enclosure defining a sump tank;

a rotatable door borne by the housing and positioned between the staging and washing areas, and wherein the door permits movement of the glasses between the staging and washing areas, and wherein the rotatable door has first and second substantially vertically disposed surfaces, and wherein a support member is fixed on at least one of the vertically disposed surfaces;

means for substantially sealing the rotatable door in an occluding position relative to the staging and washing areas, respectively, whereby water and chemicals applied to the glasses in the washing area is inhibited from moving into the staging area;

a foraminous container releasably borne by the rotatable door and operable to support the glasses along the path of travel, and wherein the support member is adapted to releasably engage the foraminous container thereby supporting the foraminous container in spaced relation relative to the drain pan;

an elevating assembly borne by the housing and positioned in the staging area for elevating the foraminous container following the washing of the glasses thereby causing water to drain off the glasses;

a filtering assembly disposed in the sump tank and operable to remove particulate matter from the mixture of water and chemicals, and wherein the filtering assembly includes a main body having inwardly and outwardly disposed surfaces which are disposed in predetermined spaced relation thereby defining a passageway, and wherein the passageway is disposed in fluid communication with the ambient atmosphere;

means borne by the housing for selectively supplying a source of water and chemicals under pressure to the washing area, and wherein the supplying means includes a pump which is borne by the housing and which is disposed in fluid communication with the sump tank, and wherein the pump is adapted to draw the mixture of water and chemical from the sump tank, the water and chemicals traveling through the inwardly and outwardly disposed surfaces of the filter assembly, and wherein particulate matter suspended in the mixture of water and chemicals is captured on the inwardly and outwardly disposed surfaces thereby clogging it, and wherein the clogging of the filter assembly has the effect of causing the pump to draw the ambient atmosphere through the passageway thereby rendering the pump inoperable;

a drain valve disposed in fluid communication with the sump and operable to drain water from the sump following the pumps deactivation;

a spray manifold rotatably borne by the housing and operable for movement along a predetermined path of travel and which is positioned in the washing area, the spray manifold including a drive shaft having a passageway disposed in fluid communication with the supplying means, and wherein the spray manifold is fixed on the drive shaft and disposed in fluid flowing communication with the passageway;

a cam having a predetermined shape and defining a cam passageway fixed on the drive shaft of the spray manifold;

an oscillating drive mechanism borne by the housing and including a motor, a gear reduction assembly disposed in driving relation relative to the motor, a drive shaft made integral with the gear reduction assembly and operable for rotational movement therewith, a drive arm fixed on the drive shaft, and a cam follower fixed on the drive arm and engageable with the cam passageway, and wherein rotational movement of the drive shaft by the motor causes a corresponding oscillating movement of the manifold along the path of travel; and control means borne by the housing and operable to selectively actuate the motor and the supplying means whereby the water and the chemicals are selectively supplied to the spray manifold for delivery to the glasses thereby cleansing and sanitizing them in an efficient fashion.

8. A washing apparatus as claimed in claim 7 and wherein the spray manifold includes first, second and third arms and wherein the first and third arms are disposed in angulated spaced relation relative to the second arm, and wherein the path of travel of the spray manifold is substantially arcuately shaped, and approximately 120 degrees wide, and wherein the spray arm includes a fluid passageway which is disposed in fluid communication with the passageway formed in the drive shaft, and wherein the spray manifold moves in a substantially horizontal plane and in a position below the foraminous container when the foraminous container is positioned in the second washing area.

9. A washing apparatus as claimed in claim 8 and wherein the drive shaft supporting the manifold is substantially vertically disposed, and wherein the cam is substantially arcuately shaped and includes a pair of sidewalls which are disposed in substantially parallel, spaced relation one to the other thereby defining the cam passageway, and wherein the drive shaft made integral with the gear assembly is substantially horizontally disposed and has an axial line of reference, and wherein the drive arm is disposed in non-coaxial alignment relative to the drive shaft.

10. A washing apparatus as claimed in claim 9 and wherein the supplying means further includes a chemical pump which is adapted to supply the source of chemicals to the housing, and wherein the apparatus further includes an upper spray manifold which is borne by the housing and disposed in the second washing area and in a position above the foraminous container, the spray manifold connected in fluid communication with the supply means and wherein the housing further includes means for releasably securing the rotatable door in an occluding position relative to the staging and washing areas, and wherein the control means is operable to ascertain the relative position of the rotatable door prior to activation of the motor and both pumps, the rotatable door being positioned in occluding relation relative to the staging and washing areas prior to activation of the motor and the respective pumps.

11. A washing apparatus as claimed in claim 10 and wherein the controlling means defines a cold rinse cycle which has a first phase which includes delivering predetermined amounts of water and chemicals to the primary tank; a second phase which includes the removal of the mixture of water and chemicals from the primary tank by the pump and the delivery of same to the spray manifold for subsequent discharge into the washing area, a third phase wherein the mixture of water and chemicals are drained from the primary and sump tanks, and rinse water is delivered to the primary tank and then withdrawn from the primary tank by the pump and delivered to the spray manifold for subsequent discharge into the second washing area, and a fourth phase wherein the rinse water is drained from the primary and sump tanks.

12. A washing apparatus as claimed in claim 11 and wherein a heater is mounted in the sump tank and is operable to transmit heat energy to the water and chemicals delivered to the primary and sump tanks, and wherein the controlling means defines a hot water rinse cycle which includes delivering predetermined amounts of water and chemicals to the primary tank, a second phase which includes the removal of the mixture of water and chemicals from the primary tank by the pump and the delivery of same to the manifold for subsequent discharge into the washing area, a third phase wherein the mixture of water and chemicals are drained from the primary and sump tanks, and rinse water is delivered to the primary tank and then withdrawn from the primary tank by the pump and delivered to the spray manifold for subsequent discharge into the washing area, and a fourth phase wherein the rinse water is retained in the primary tank for use in the next wash cycle and wherein in the next immediate wash cycle, the chemicals are delivered to the tank and mixed with the rinse water of the previous wash cycle.

13. A washing apparatus for supplying a cleansing fluid to an object of interest, comprising:

a housing for enclosing the apparatus and defining an internal washing area, and an external staging area, and wherein the internal washing area includes an upper portion and a lower portion, and wherein the lower portion includes a sump tank and a primary tank which are disposed in fluid transmitting relation one with the other;

a rotatable door borne by the housing and operable to carry the object of interest between the staging and washing areas, the rotatable door positioning the object of interest in the upper portion of the washing area;

a spray manifold mounted on the housing and disposed in the washing are, the spray manifold operable for oscillating movement along a substantially horizontally disposed and arcuately shaped path of travel;

means borne by the housing for selectively supplying the cleansing fluid to the spray manifold, the supplying means including valve means and first and second pumps, and wherein the valve means and the first pump operate in combination to selectively deliver predetermined quantities of cleansing fluid to the primary tank, and wherein the second pump selectively withdraws the cleansing fluid from the sump tank and supplies it to the spray manifold;

a drive mechanism borne by the housing and operable to cause the oscillating movement of the spray manifold along the path of travel;

a drain valve disposed in fluid draining relation relative to the sump tank;

a filtering assembly disposed in the sum tank and operable to substantially remove particulate matte from the cleansing fluid thereby preventing its delivery to the spray manifold, the filtering assembly further connected in fluid communication with the ambient atmosphere, and wherein the second pump is operable, when the filtering assembly becomes substantially clogged with particulate matter, to draw i the ambient atmosphere through the filtering assembly thereby rendering the second pump substantially inoperable; and means for selectively controlling the supplying means and the drive mechanism whereby the supplying means and the drive mechanism can be activated when the rotatable door is in a predetermined position relative to the staging and washing areas, and wherein the controlling means operates to actuate the drain valve thereby draining the primary and sump tanks when the second pump is rendered inoperable following the clogging of the filtering assembly, the action of draining the primary and sump tanks having the effect of removing the particulate matter which has been captured by the filtering assembly.

14. A washing apparatus for supplying a cleansing fluid to an object of interest;

a housing defining a washing area which includes an upper portion, and a lower portion, and wherein the lower portion includes a tank for receiving the cleansing fluid, and wherein the housing further defines an opening which permits access to the washing area;

a door borne by the housing and operable to occlude the opening, the door adapted to support the article of interest in a predetermined position in the upper portion of the washing area when the door is disposed in a substantially occluding position relative to the opening;

a spray manifold disposed in the washing area and located below the article of interest when the article of interest is positioned in the washing area, the spray manifold operable for movement along a predetermined path of travel;

means borne by the housing for selectively supplying the cleansing fluid to the spray manifold, the supplying means including a valve means which selectively meters the cleansing fluid into the tank, and a pump which withdraws the cleansing fluid from the tank and supplies it to the spray manifold;

a drive mechanism borne by the housing and causing the oscillating movement of the spray manifold;

a filtering assembly disposed in the tank for removing particulate matter from the cleansing fluid, the pump drawing the cleansing fluid through the filtering assembly prior to delivering the cleansing fluid to the spray manifold, the filtering assembly disposed in fluid communication with the ambient atmosphere, and wherein the pump is operable to draw in the ambient atmosphere through the filtering assembly thereby rendering the pump inoperable when the filtering assembly becomes clogged with particulate matter;

a drain valve disposed in fluid draining relation relative to the tank; and means for selectively controlling the supplying means and the drive mechanism whereby the supplying means and drive mechanism can be actuated when the door is disposed in a predetermined position relative to the housing, and wherein the controlling means further activates the drain valve thereby draining the tank when the pump is rendered inoperable, the draining of the tank having the effect of removing particulate matter which has clogged the filter assembly.

15. A washing apparatus for supplying a cleansing fluid to an object of interest;

a housing defining a washing area which includes an upper portion which receives the object of interest, and a lower portion, and wherein the lower portion includes a tank for receiving the cleansing fluid, and wherein the housing further defines an opening which permits the object of interest to be positioned in the washing area;

a spray manifold disposed in the washing area and located below the article of interest when the article of interest is positioned in the washing area;

means borne by the housing for selectively supplying the cleansing fluid to the spray manifold, the supplying means including a valve means which selectively meters the cleansing fluid into the tank, and a pump which withdraws the cleansing fluid from the tank and supplies it to the spray manifold;

a filtering assembly disposed in the tank for removing particulate matter from the cleansing fluid, the pump drawing the cleansing fluid through the filtering assembly prior to delivering the cleansing fluid to the spray manifold, the filtering assembly further disposed in fluid communication with the ambient atmosphere, and wherein the pump is operable to draw in the ambient atmosphere through the filtering assembly thereby rendering the pump inoperable when the filtering assembly becomes clogged with particulate matter;

a drain valve disposed in fluid draining relation relative to the tank; and means for selectively controlling the supplying means whereby the supplying means can be actuated when the object of interest is disposed in the washing area, and wherein the controlling means further activates the drain valve thereby draining the tank when the pump is rendered inoperable, the draining of the tank having the effect of removing particulate matter which has clogged the filter assembly.

16. A washing apparatus for supplying a cleansing fluid to an object of interest;

a housing defining a washing area including a tan for receiving the cleansing fluid, and wherein the housing further defines an opening which permits the object of interest to be positioned in the washing area;

a spray manifold borne by the housing and disposed in the washing area;

means borne by the housing for selectively supplying the cleansing fluid to the spray manifold, the supplying means including a pump which withdraws the cleansing fluid from the tank and supplies it to the spray manifold;

a filtering assembly disposed in the tank for removing particulate matter from the cleansing fluid, the pump drawing the cleansing fluid through the filtering assembly prior to delivering the cleansing fluid to the spray manifold, the filtering assembly further disposed in fluid communication with the ambient atmosphere, and wherein the pump is operable to draw in the ambient atmosphere through the filtering assembly thereby rendering the pump inoperable when the filtering assembly becomes clogged with particulate matter;

a drain valve dispose din fluid draining relation relative to the tank; and means for selectively controlling the supplying means whereby the supplying means may be actuated when the object of interest is disposed in the washing area, and wherein the controlling means further activates the drain valve thereby draining the tank when the pump is rendered inoperable, the draining of the tank having the effect of removing the particulate matter which has clogged the filter assembly.

17. In a washing assembly for supplying a fluid to an object of interest, an apparatus for removing particulate matter from the fluid comprising:

a container for receiving the fluid;

a pump mounted in fluid withdrawing relation relative to the container and operable to deliver the fluid to the object of interest;

a filtering assembly disposed in fluid flowing relation relative to the container for removing particulate matter from the fluid, the pump drawing the fluid through the filtering assembly prior to delivering the fluid to the object of interest, the filtering assembly further disposed in fluid communication with the ambient atmosphere, and wherein the pump draws in the ambient atmosphere through the filtering assembly thereby rendering the pump inoperable when the filtering assembly becomes substantially clogged with particulate matter;

a drain valve disposed in fluid releasing relation relative to the container; and means for selectively controlling the pump, and the valve, and wherein the controlling means selectively activates the pump causing withdrawal of fluid from the container, and the drain valve is activated thereby releasing fluid from the container when the pump is rendered inoperable, the release of fluid from the tank having the effect of removing the particulate matter which has substantially clogged the filtering assembly.

* * * * *

UNITED STATES PATENT AND TRADEMARK OFFICE

CERTIFICATE OF CORRECTION

PATENT NO. : 5,027,840

DATED : July 2, 1991

INVENTOR(S) : James E. Nezworski

It is certified that error appears in the above-identified patent and that said Letters Patent is hereby corrected as shown below:

Column 21, line 5, cancel "a" and insert --at--;

Column 26, line 6, cancel "are" and insert --area--;

Column 28, line 53, cancel "are" and insert --area--;

Column 29, line 4, cancel "matte" and insert --matter--;

Column 29, line 11, cancel "i" and insert --in--;

Column 30, line 52, cancel the word "tan" and insert --tank--;

Column 31, line 6, cancel the words "dispose din" and insert --disposed in--;

Signed and Sealed this

Twenty-ninth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,027,840

DATED : July 2, 1991

INVENTOR(S) : James E. Nezworski

It is certified that error appears in the above-indentified patent and that said Letters Patent is hereby corrected as shown below:

Column 4, line 28, cancel --surface-- and insert --surfaces--;

Column 29, line 28, after the word "interest", cancel --;-- and insert --comprising:--;

Column 30, line 10, after the word "interest", cancel --;-- and insert --comprising:--;

Column 30, line 50, after the word "interest", cancel --;-- and insert --comprising:--;

Column 30, line 52, cancel the word --tan-- and insert --tank--.

Signed and Sealed this

Nineteenth Day of October, 1993

*Attest:*

Bruce Lehman

BRUCE LEHMAN

*Attesting Officer*

*Commissioner of Patents and Trademarks*